US006655495B2

(12) United States Patent
Kuze et al.

(10) Patent No.: US 6,655,495 B2
(45) Date of Patent: Dec. 2, 2003

(54) LOUDSPEAKER DAMPER AND LOUDSPEAKER

(75) Inventors: Mitsukazu Kuze, Osaka (JP); Hiroyuki Takewa, Kaizuka (JP); Kazue Satoh, Neyagawa (JP); Mikio Iwasa, Katano (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/268,072

(22) Filed: Oct. 10, 2002

(65) Prior Publication Data

US 2003/0079936 A1 May 1, 2003

(30) Foreign Application Priority Data

Oct. 16, 2001 (JP) ..... 2001-317960

(51) Int. Cl.[7] ..... G10K 13/00; H04R 7/00

(52) U.S. Cl. ..... 181/171; 181/144; 181/148; 181/172; 181/173

(58) Field of Search ..... 181/171, 172, 181/173, 174, 166, 199, 165, 179, 181, 184, 208, 144, 148; 381/386, 392, 404, 413, 423, 430, 431

(56) References Cited

U.S. PATENT DOCUMENTS

| | | | | | |
|---|---|---|---|---|---|
| 3,935,400 | A | * | 1/1976 | Koga | 356/521 |
| 4,239,944 | A | * | 12/1980 | Obara et al. | 181/171 |
| 5,682,436 | A | * | 10/1997 | Sakamoto et al. | 381/408 |
| 6,176,345 | B1 | * | 1/2001 | Perkins et al. | 181/173 |

FOREIGN PATENT DOCUMENTS

| | | |
|---|---|---|
| JP | 62-109596 U | 7/1987 |
| JP | 62-109597 U | 7/1987 |

* cited by examiner

*Primary Examiner*—Robert E. Nappi
*Assistant Examiner*—Ranata McCloud
(74) *Attorney, Agent, or Firm*—Smith Patent Office

(57) ABSTRACT

A damper 3A is provided with an inner peripheral waveform portion 11 and an outer peripheral waveform portion 12. A flat portion 10 is provided between the inner peripheral waveform portion 11 and the outer peripheral waveform portion 12. When the damper is used for a loudspeaker, the flat portion 10 does not elastically deform in a radial direction R, so that linearity of the damper 3A in a vibrating direction Z is ensured by elastic deformation of the waveform portions. In addition, a rolling phenomenon of a voice coil bobbin and a diaphragm can be suppressed.

18 Claims, 27 Drawing Sheets

LOUDSPEAKER DAMPER AND LOUDSPEAKER

BACKGROUND OF THE INVENTION

1. Field of the Invention

The present invention relates to a loudspeaker damper serving as a supporting system of diaphragm and a loudspeaker using the damper.

2. Description of the Related Art

A structure of a conventional loudspeaker and a loudspeaker damper will be described. FIG. 1 is a cross-sectional view showing a structure of a loudspeaker using a conventional damper. As shown in FIG. 1, the loudspeaker includes a voice coil bobbin 1, a diaphragm 2, a damper 3P, an edge 4 and a frame 5. A reference letter Z shown in FIG. 1 indicates a direction that the voice coil bobbin 1 vibrates during operation of the loudspeaker, and a reference letter R indicates a direction perpendicular to the Z direction, i.e., a radial direction of loudspeaker.

A voice coil 1*a* is wound around a lower portion of the voice coil bobbin 1. The voice coil bobbin 1 is elastically held, together with the diaphragm 2, at the frame 5 by the damper 3P. An outer peripheral portion of the diaphragm 2 is supported to the frame 5 by the edge 4 so as to vibrate. A magnet 6, a yoke 7 and a plate 8 constitute a magnetic circuit and a magnetic flux is generated at a magnetic gap 9. When a signal current is applied to the voice coil 1*a* placed within the magnetic gap 9, the voice coil bobbin 1 vibrates, by means of the magnetic flux of the magnetic gap 9, in the Z direction with a driving force which is proportional to the signal current. The vibration is transmitted to the diaphragm 2, so that sound is radiated.

In accordance with such a conventional loudspeaker, in order to vibrate the voice coil bobbin 1 and the diaphragm 2 so as to follow a signal current, a cross-sectional shape of the damper 3P is formed in a wavy shape. Further, a radial direction of the damper is expandable and contractible. In this way, the damper 3P easily vibrates in the Z direction.

In the case where the damper 3P has a wavy cross-sectional shape, the damper 3P easily vibrates also in the R direction. Ideally, the voice coil bobbin 1 and the diaphragm 2 vibrate only in the Z direction in proportion to a signal current. In accordance with an actual loudspeaker, however, vibration in the R direction as well as the Z direction is induced due to variations in assembling of the loudspeaker and weight balance, and force applied to the loudspeaker depending on an installation method.

Vibration in the R direction is referred to as a rolling phenomenon. If the rolling phenomenon occurs, the voice coil 1*a* abuts the yoke 7 or the plate 8 at a time of operation of the loudspeaker, so that unpleasant noise is generated or the voice coil 1*a* is broken. If the magnetic gap 9 is broaden in order to prevent such abutment of the voice coil 1*a*, an efficiency of electro acoustic conversion of the loudspeaker is reduced. Accordingly, if the rolling phenomenon can be suppressed while maintaining a distance of the magnetic gap 9 at a predetermined value, generation of unpleasant noise and failure of the voice coil 1*a* can be prevented and a high performance loudspeaker with high efficiency can be realized.

SUMMARY OF THE INVENTION

A loudspeaker damper of the present invention is configured by an annular member so as to have a central opening portion, and is provided with an outer peripheral waveform portion which has at least one concave or convex annular waveform at an outer peripheral portion, an inner peripheral waveform portion which has at least one concave or convex annular waveform at an inner peripheral portion, and a flat portion which is provided between the outer peripheral waveform portion and the inner peripheral waveform portion and has an annular flat surface.

A loudspeaker of the present invention is provided with a loudspeaker frame, a diaphragm which has an outer peripheral portion held by the loudspeaker frame so as to vibrate and applies aerial vibration, a cylindrical voice coil bobbin which is coupled to an inner peripheral portion of the diaphragm, a voice coil which is wound around the voice coil bobbin, a magnetic circuit which applies an electromagnetic force to the voice coil and a damper which has an outer peripheral portion held by the loudspeaker frame so as to vibrate and holds the voice coil bobbin so as to axially vibrate.

DETAILED DESCRIPTION OF THE PREFERRED EMBODIMENTS

Figure 2:
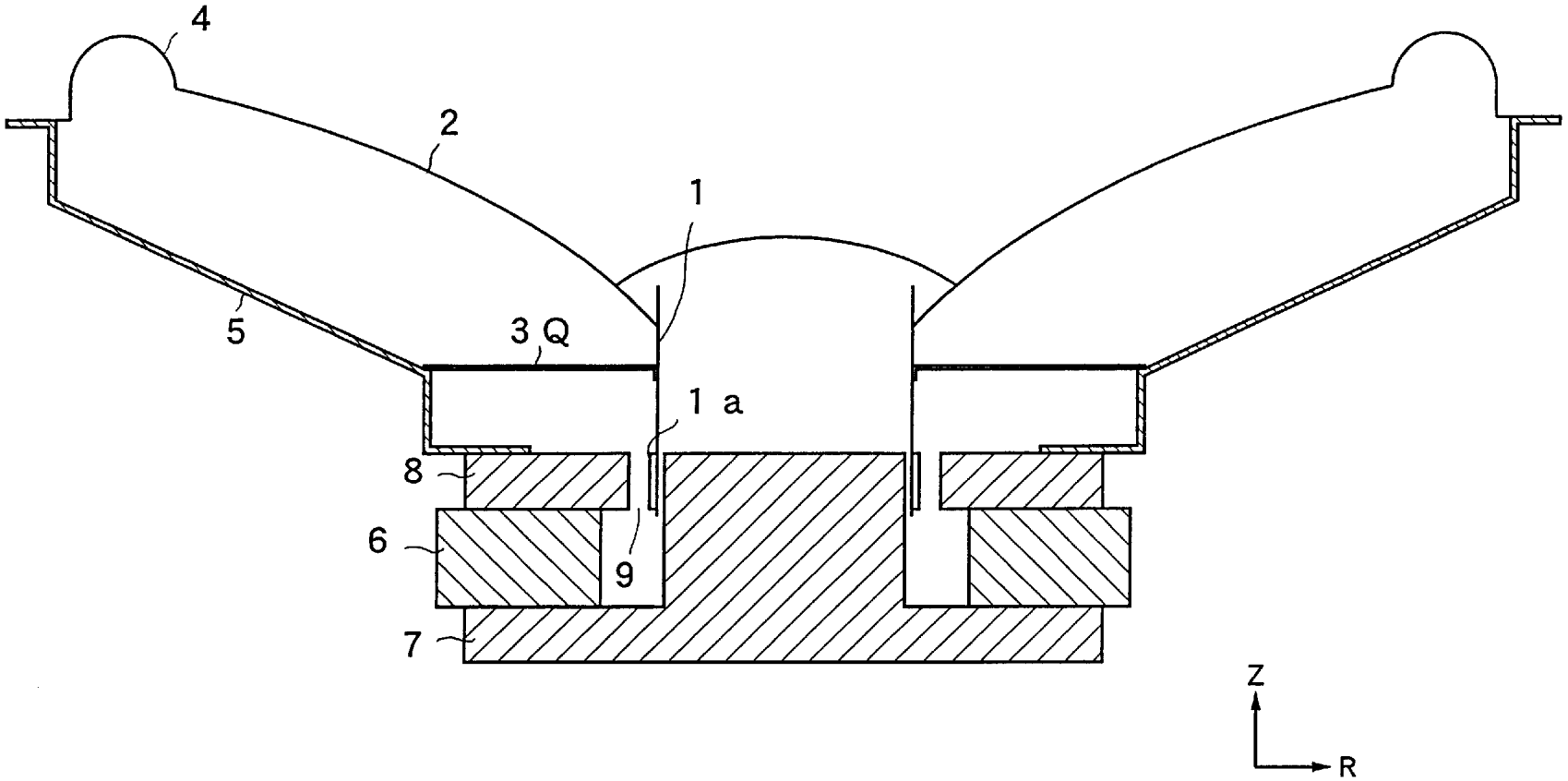
FIG. 2 is a cross-sectional view showing a structure of a virtual loudspeaker using a flat damper.

FIG. 2 is a cross-sectional view of a virtual loudspeaker using a flat plate damper. If a damper 3Q is configured as completely flat surface as in a case of the loudspeaker shown in FIG. 2, the damper 3Q is difficult to move in an R direction, so that the rolling phenomenon can be suppressed. At the same time, however, the damper 3Q is difficult to move in a Z direction. Thus, linearity of amplitude of a diaphragm 2 with respect to driving force cannot be obtained. Further, tone quality of the loudspeaker is significantly deteriorated and maximum sound pressure is also reduced.

Figure 3:
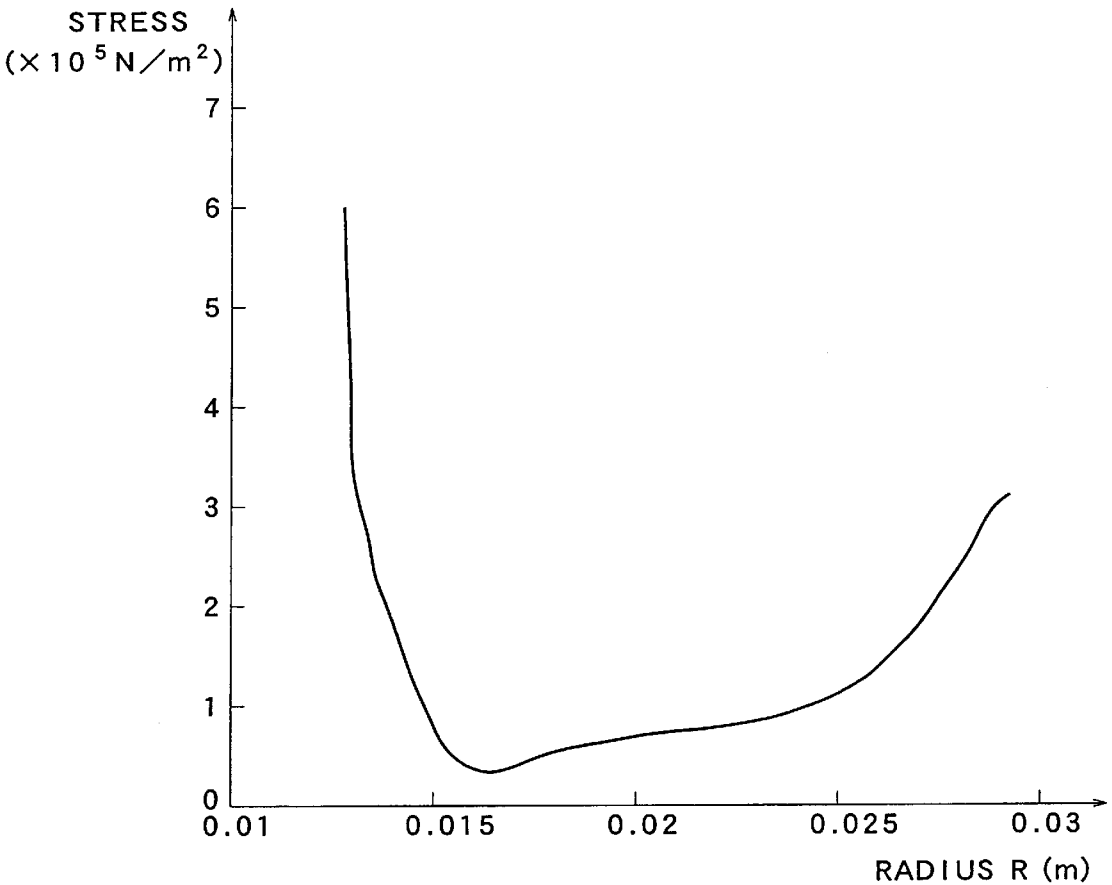
FIG. 3 is a characteristic view showing the relationship between a radial position and a stress distribution when the flat damper is vibrated.

FIG. 3 is a characteristic view showing the relationship between a radial position of the damper and a stress applied to a portion of the damper placed at the radial position. The relationship is obtained as follows. Firstly, the flat damper 3Q used in the loudspeaker of FIG. 2 is determined as an object of analysis. Then, an outer periphery of the damper is fixed and a Z direction force is applied to an inner periphery of the damper such that each of the portions of the damper is displaced in the Z direction. A horizontal axis shown in FIG. 3 indicates a radial position of the respective portions of the damper, and a vertical axis indicates a stress applied to the respective portions of the damper. As shown in the characteristic view, the portions with large stress are an outer peripheral portion and an inner peripheral portion of the damper. Accordingly, such portions are formed in a wavy shape so as to easily move in the Z direction and other portions are formed in a planar shape not so as to move in the R direction. As a result, the rolling phenomenon can be suppressed and an excellent damper that a linearity of amplitude of diaphragm is not deteriorated can be realized.

Figure 1:
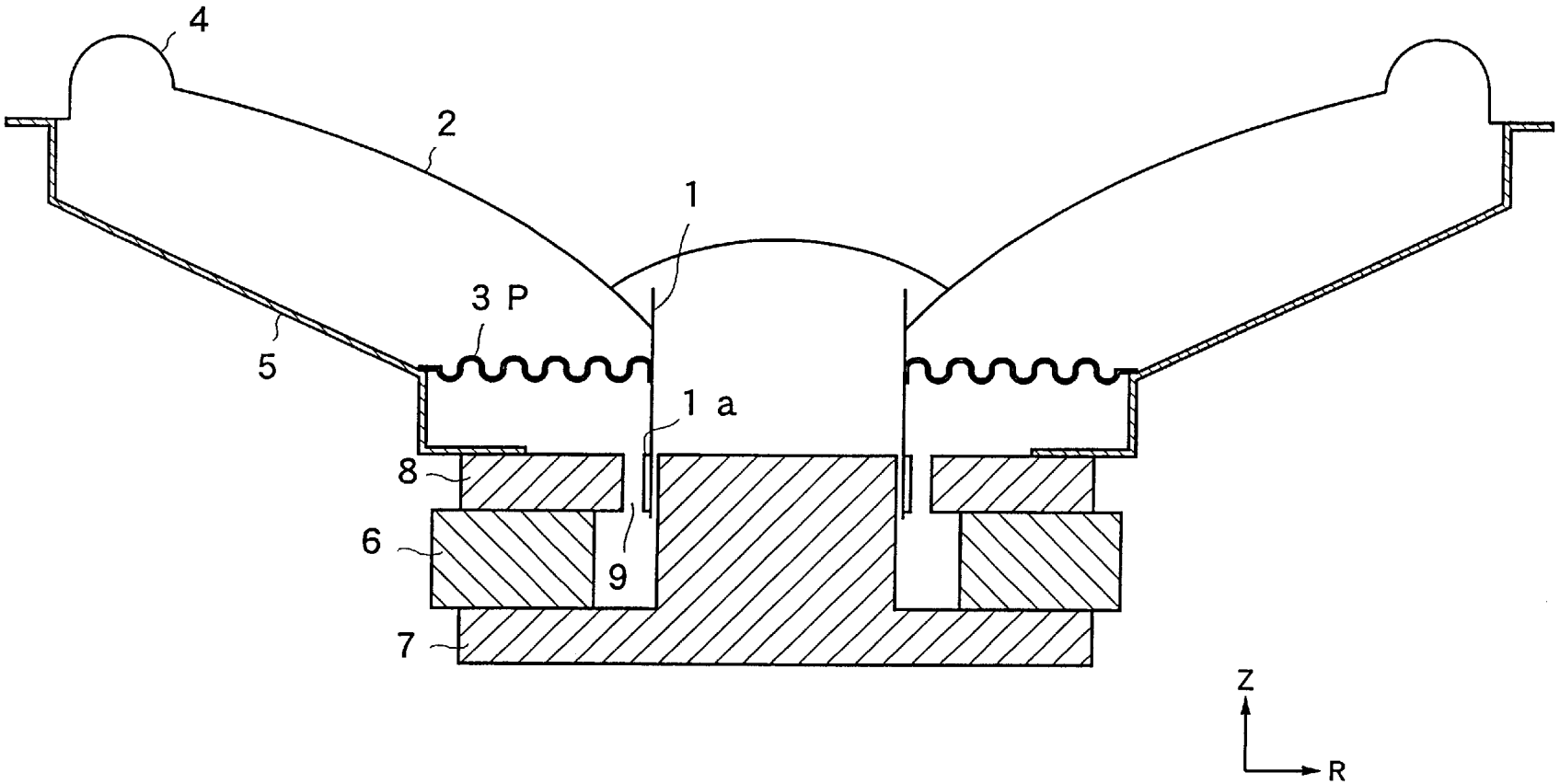
FIG. 1 (PRIOR ART)
FIG. 1 is a cross-sectional view showing a structure of a conventional loudspeaker using a waveform damper.

A loudspeaker and a loudspeaker damper according to embodiments of the present invention will be described with reference to the drawings. The same elements as those of a conventional loudspeaker shown in FIG. 1 are denoted by the same reference numerals, so that detailed description thereof will not be repeated.

(Embodiment 1)

Figure 4:
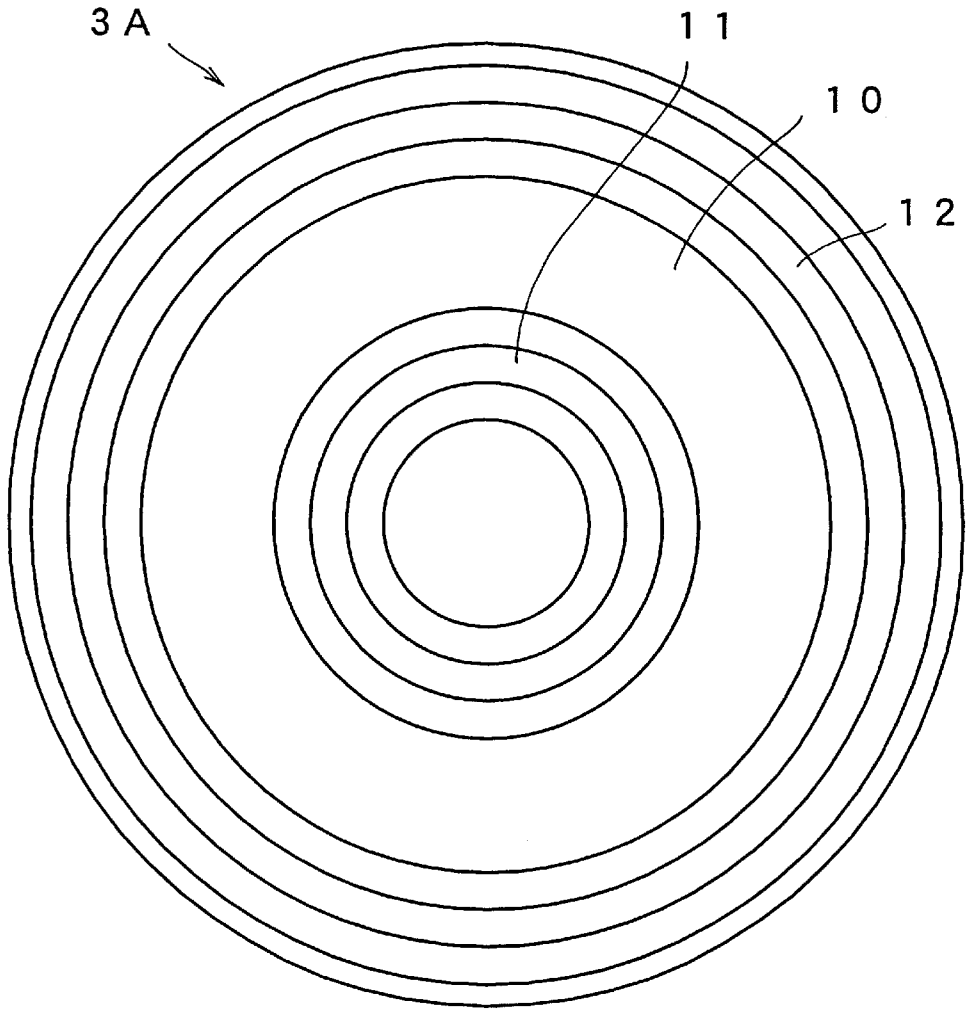
FIG. 4 is a plan view showing a structure of a loudspeaker damper according to Embodiment 1 of the present invention.
Figure 5:
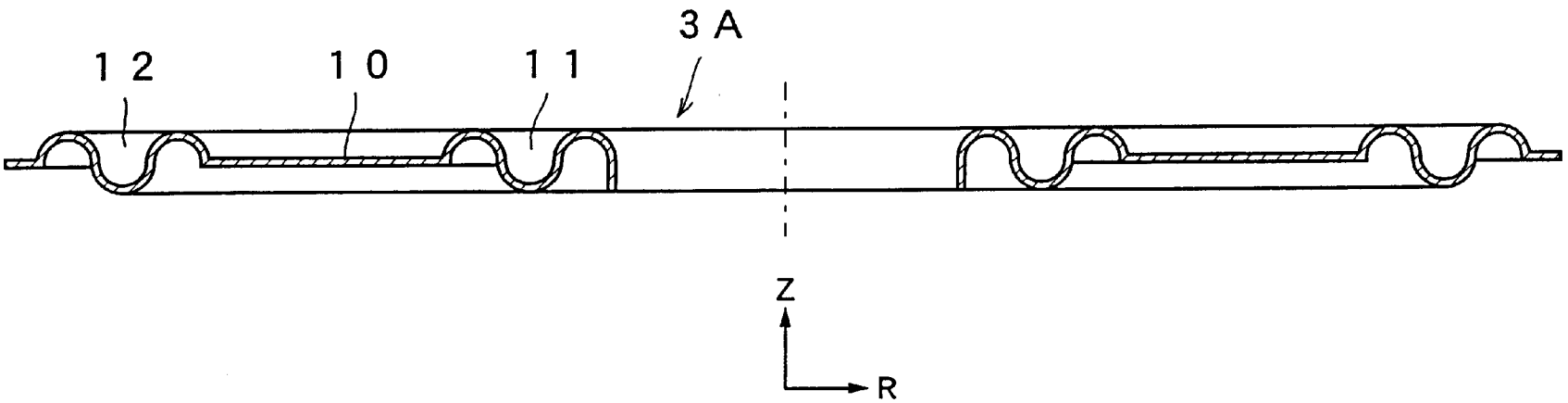
FIG. 5 is a cross-sectional view showing the structure of the loudspeaker damper according to Embodiment 1.

FIG. 4 is a plan view showing a structure of a loudspeaker damper according to Embodiment 1 of the present invention. In the following description, a loudspeaker damper will be simply referred to as a damper. FIG. 5 is a cross-sectional view showing a shape of damper, cut so as to include a central axis of the damper. A damper 3A of this embodiment is, as shown in FIG. 4, configured by an annular member so as to have a hollow opening portion. A waveform portion is formed at an inner peripheral portion of the damper and this waveform portion is referred to as an inner peripheral waveform portion 11. A waveform portion is also formed at an outer peripheral portion thereof and this waveform portion is referred to as an outer peripheral waveform portion 12. Such concave or convex annular grooves are referred to as annular waveforms.

A flat portion 10 which has an annular flat surface parallel to a radial direction of the damper is formed between the inner peripheral waveform portion 11 and the outer peripheral waveform portion 12. An inner side of the inner peripheral waveform portion 11 is open so as to become a complete round such that the voice coil bobbin 1 can be fixed thereto. In a case of assembling the damper 3A into a loudspeaker, as shown in FIG. 5, a direction that the voice coil bobbin 1 vibrates is determined as the Z direction and a radial direction of the damper 3A is determined as the R direction.

Effects of the damper with such structure will be described. Because the flat portion 10 is provided, the damper 3A hardly expands or contracts in the R direction. With respect to the direction that the voice coil bobbin 1 vibrates, due to the inner and outer peripheral waveform portions 11 and 12, the inner and outer peripheral portions receiving a large stress can easily move. For this reason, elastic fatigue of material of the damper can be reduced and vibration of the damper 3A in the Z direction is hardly prevented. As a result, the voice coil bobbin 1 hardly induces the rolling phenomenon, so that the loudspeaker damper with excellent linearity can be obtained.

Figure 6:
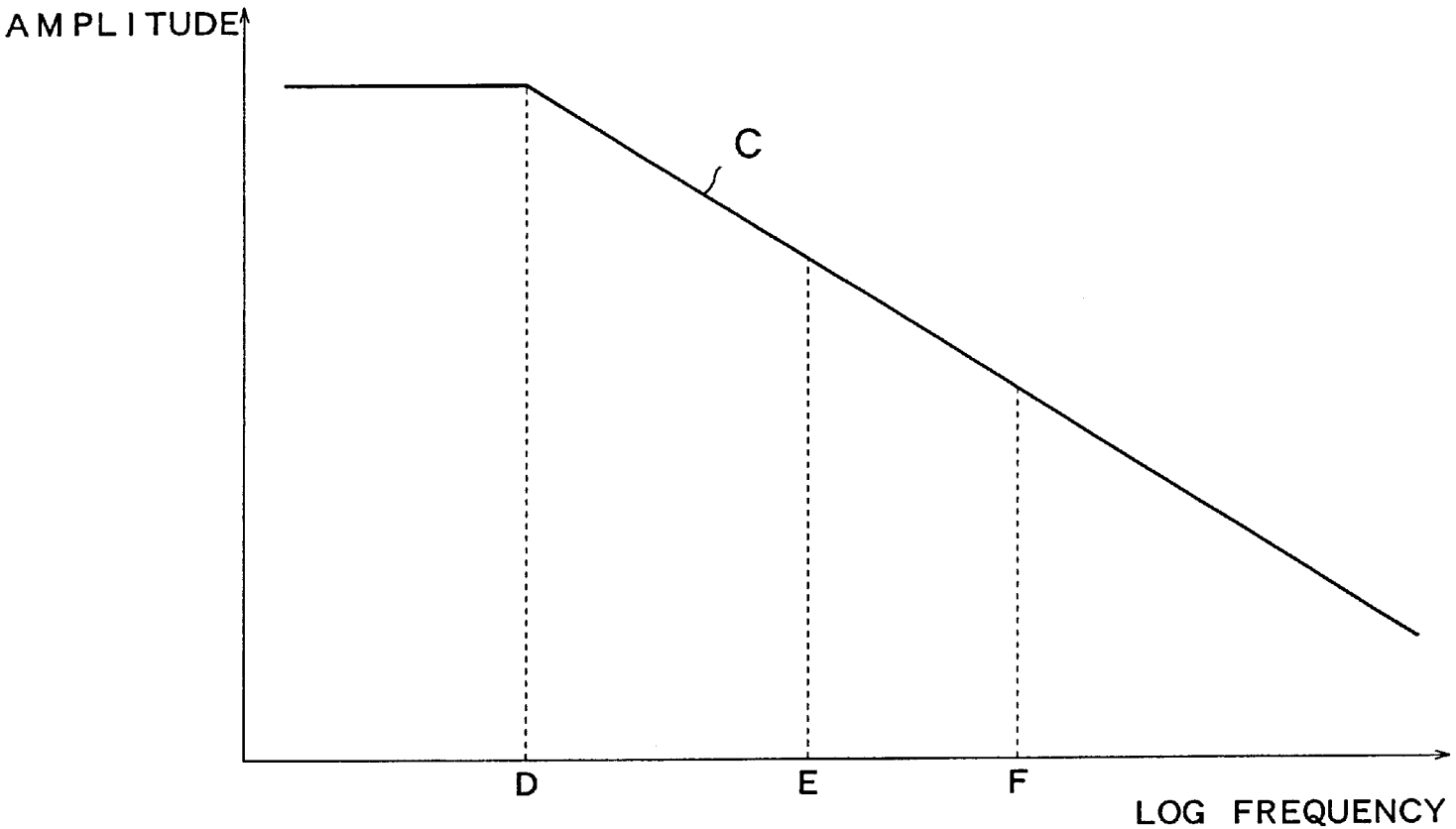
FIG. 6 is a characteristic view showing the relationship between an amplitude characteristic of a diaphragm of a loudspeaker, and a minimum resonance frequency and a rolling frequency.

FIG. 6 is a frequency characteristic view showing a vibration amplitude of voice coil of a loudspeaker when a certain signal current is applied thereto. At a horizontal axis, a frequency is indicated by logarithm (log frequency). A vertical axis indicates a relative amplitude value. A reference letter C in FIG. 6 indicates an amplitude value. A reference letter D indicates a minimum resonance frequency of the loudspeaker, a reference letter E indicates a frequency at which rolling of the conventional waveform damper occurs most (which hereinafter is referred to as rolling frequency) and a reference letter F indicates a rolling frequency when the damper according to Embodiment 1 is used.

In general, an amplitude of the diaphragm of the loudspeaker attenuates at a rate of 12 dB per octave at the area with minimum resonance frequency or higher. For this reason, higher the frequency is, smaller the amplitude is. Thus, by increasing a rolling frequency, an amount of amplitude of rolling can be minimized. Consequently, a magnetic gap needs not to be made narrow more than needed and contact of voice coil can be prevented. For example, a case of applying conventional damper to a loudspeaker is compared to a case of applying a damper of Embodiment 1 to a loudspeaker. The conventional damper and the damper of Embodiment 1 have the same total length seen from a cross section thereof (i.e., the same outer diameter dimension).

The following table shows a ratio Ra of rolling frequency to minimum resonance frequency, a rolling frequency $f_R$ with the minimum resonance frequency being 100 Hz, an R direction amplitude amount $A_R$ in the rolling frequency and a Z direction maximum amplitude amount $A_z$.

TABLE 1

| | Ra | $f_R$ | $A_R$ | $A_z$ |
|---|---|---|---|---|
| Conventional Example | 4.82 | 482 Hz | 100% | 100% |
| Embodiment 1 | 5.79 | 579 Hz | 75.8% | 100% |

Figure 7:
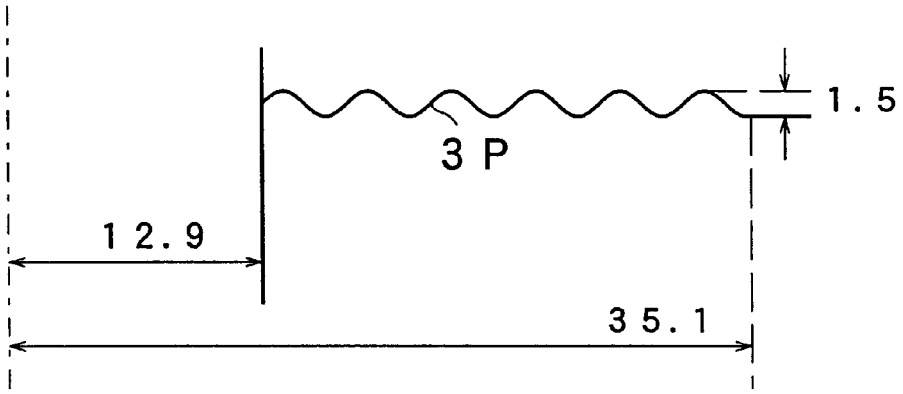
FIG. 7 (PRIOR ART)
FIG. 7 is an explanatory view showing a shape and a dimension of a conventional damper.
Figure 8:
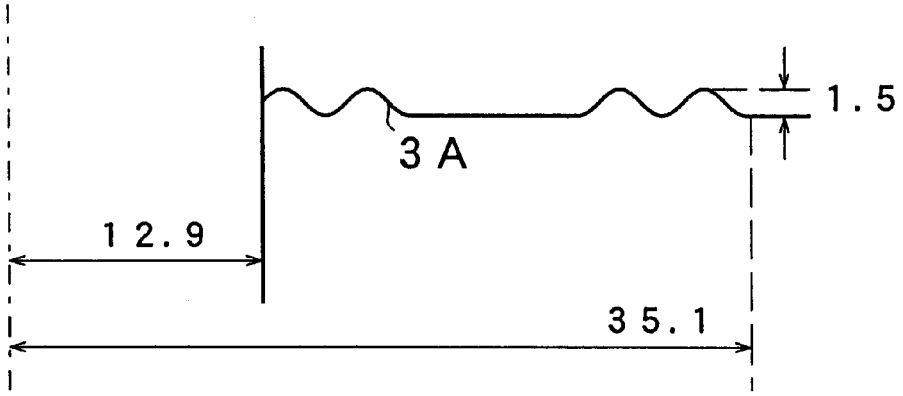
FIG. 8 is an explanatory view showing a shape and a dimension of the damper according to Embodiment 1.
Figure 9:
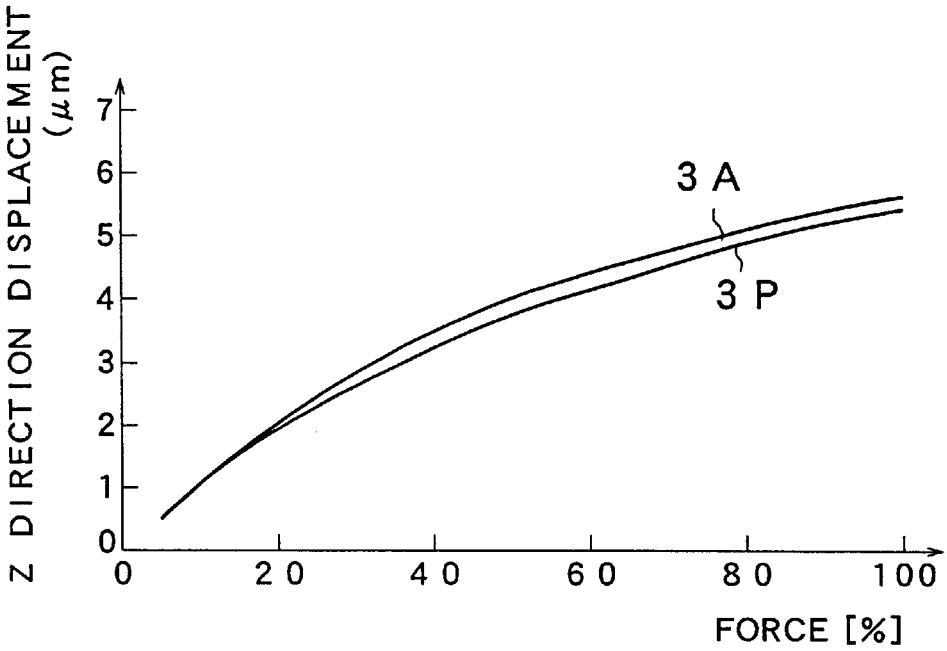
FIG. 9 is a characteristic view showing the relationship between a driving force for the diaphragm and a displacement amount in the conventional loudspeaker and the loudspeaker according to Embodiment 1.

FIG. 7 shows dimensions of a part of a voice coil bobbin and main portions of the conventional damper 3P. FIG. 8 shows dimensions of a part of the voice coil bobbin and the main portions of damper 3A of Embodiment 1. A unit is mm. FIG. 9 shows the relationship between a driving force and a Z direction displacement amount of the inner peripheral portions of the dampers 3P and 3A when a Z direction driving force is applied to the voice coil bobbin 1. Referring to FIG. 9 and the above table, the damper 3A of Embodiment 1 can obtains excellent effects in that the rolling phenomenon is suppressed without reducing a maximum amplitude of diaphragm.

The damper 3P shown in FIG. 1 has totally ten convexes and concaves. In contrast, the damper 3A shown in FIG. 4 has three concaves and convexes at the inner peripheral waveform portion 11 and three concaves and convexes at the outer peripheral waveform portion 12, i.e., has totally six annular waveforms. The flat portion 10 is formed such that an outer diameter of the damper is not changed and the number of convexes and concaves is reduced. The number of annular waveforms may be any number and can be appropriately selected depending on easiness of manufacturing, linearity with respect to amplitude and shape of loudspeaker. In accordance with results of various trials, it has been found that an annular width W of the flat portion 10 is preferably equal to or larger than a groove width of annular waveform of the outer peripheral waveform portion or the inner peripheral waveform portion.

The flat portion 10 may be made of materials having higher Young's modulus than materials for the inner and outer peripheral waveform portions. For example, the flat portion 10 is made of plastic and the inner peripheral waveform portion 11 and the outer peripheral waveform portion 12 are made of fabrics. Young's modulus on radial direction of the flat portion may be larger than at least one of Young's modulus on radial direction of the outer peripheral waveform portion and a Young's modulus on radial direction of said inner peripheral waveform portion. Thus, stiffness of the flat portion 10 becomes larger and the effect of suppressing the rolling phenomenon can be even further enhanced.

(Embodiment 2)

Figure 10:
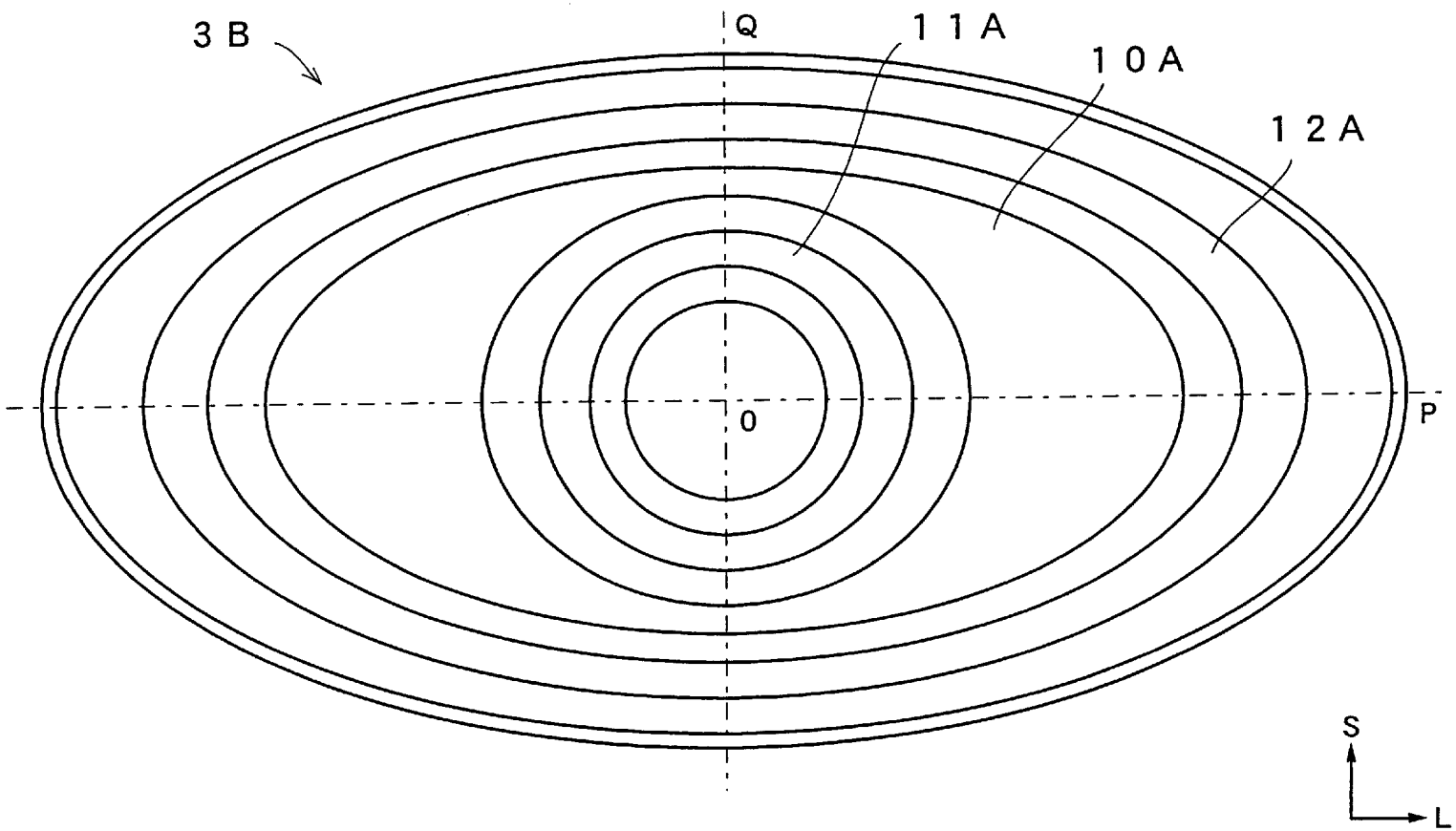
FIG. 10 is a plan view showing a structure of a loudspeaker damper according to Embodiment 2 of the present invention.
Figure 11:
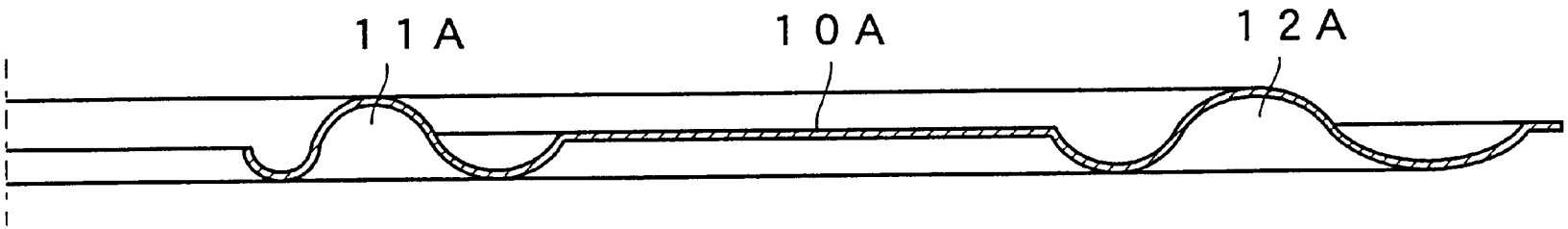
FIG. 11 is a cross-sectional view taken along line O-P, showing the structure of the loudspeaker damper according to Embodiment 2.
Figure 12:
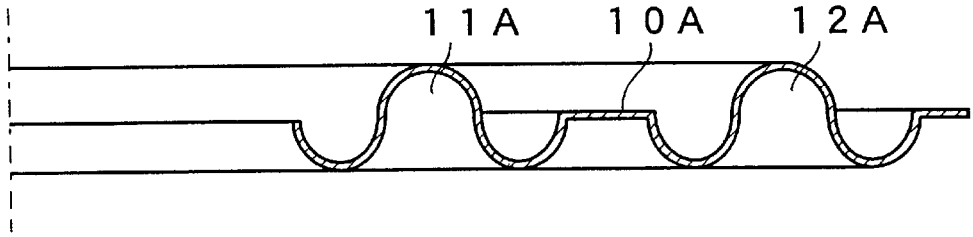
FIG. 12 is a cross-sectional view taken along line O-Q, showing the structure of the loudspeaker damper according to Embodiment 2.

Next, a damper according to Embodiment 2 of the present invention will be described. FIG. 10 is a plan view showing a structure of damper of Embodiment 2. FIG. 11 is a cross-sectional view taken along line O-P shown in FIG. 10. FIG. 12 is a cross-sectional view taken along line O-Q shown in FIG. 10. The damper 3B is configured by an annular member with elliptic outline. As in Embodiment 1, complete round shaped opening is formed at an inner peripheral portion of the damper 3B such that the voice coil bobbin 1 is attached thereto. The damper 3B includes a flat portion 10A with elliptic outer peripheral profile, an outer peripheral waveform portion 12A with elliptic outer peripheral and inner peripheral profiles and an inner peripheral waveform portion 11A whose outer peripheral profile fits the flat portion 10A. As shown in FIG. 10, a direction of short axis of the damper is indicated by S and a direction of long axis of the damper is indicated by L. As seen from comparison between FIG. 11 and FIG. 12, a width of concave or convex of each waveform portion and a distance between concaves or convexes vary significantly particularly in the L axis direction.

Effects of the damper with such structure will be described. Stiffness of elliptic damper is governed by a shape in the short axis direction. By setting an area of the flat portion 10A in the long axis direction to be large, as compared to an elliptic damper with ordinary waveform, the rolling phenomenon can be suppressed without varying significantly the minimum resonance frequency of the loudspeaker.

Figure 13:
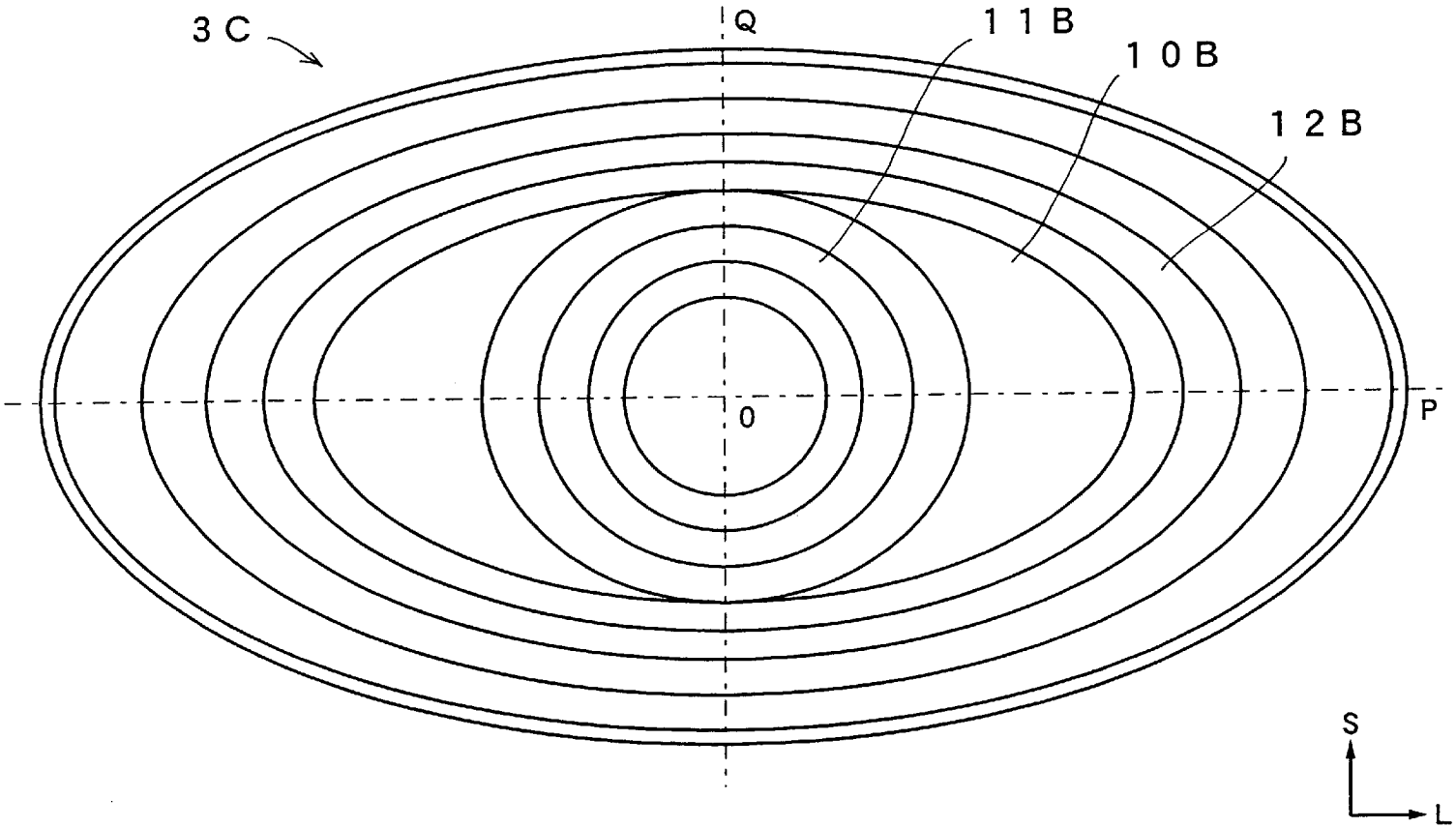
FIG. 13 is a plan view showing a structure of a loudspeaker damper with another shape according to Embodiment 2 of the present invention.
Figure 14:
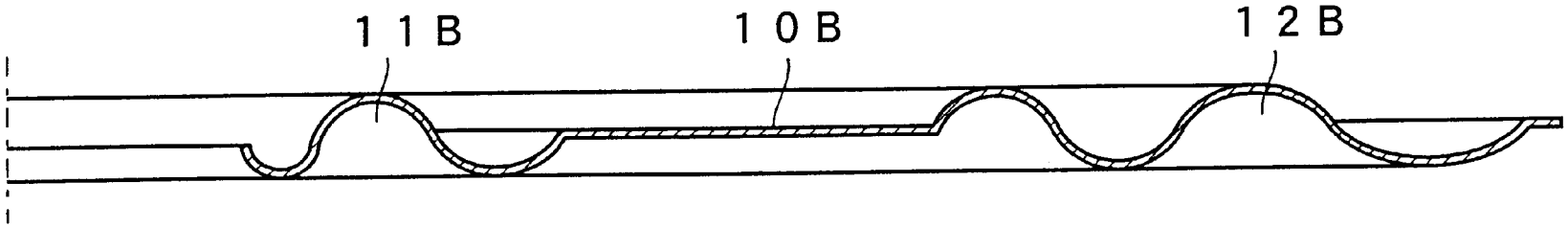
FIG. 14 is a cross-sectional view taken along line O-P, showing the structure of the loudspeaker damper with another shape according to Embodiment 2.
Figure 15:
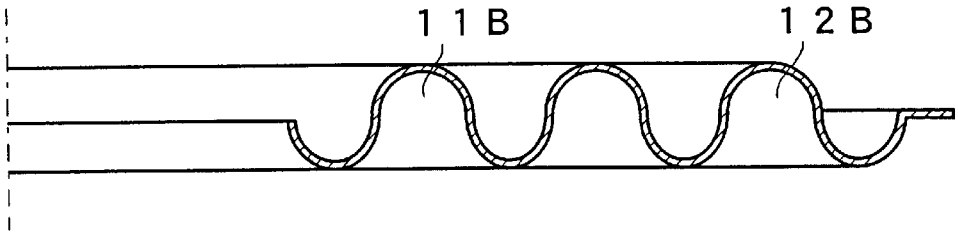
FIG. 15 is a cross-sectional view taken along line O-Q, showing the structure of the loudspeaker damper with another shape according to Embodiment 2.

FIGS. 13, 14 and 15 show another structural examples of the damper of Embodiment 2. FIG. 13 is a plan view of damper 3C. FIG. 14 is a cross-sectional view taken along line O-P shown in FIG. 13. FIG. 15 is a cross-sectional view taken along line O-Q shown in FIG. 13. As shown in FIG. 13, the damper 3C includes a flat portion 10B, an inner peripheral waveform portion 11B and an outer peripheral waveform portion 12B. As shown in FIG. 13, a short diameter of outer periphery of the flat portion 10B may be the same as a short diameter of inner periphery thereof. Also with such structure, the rolling phenomenon can be suppressed without varying significantly the minimum resonance frequency of the loudspeaker.

(Embodiment 3)

Figure 16:
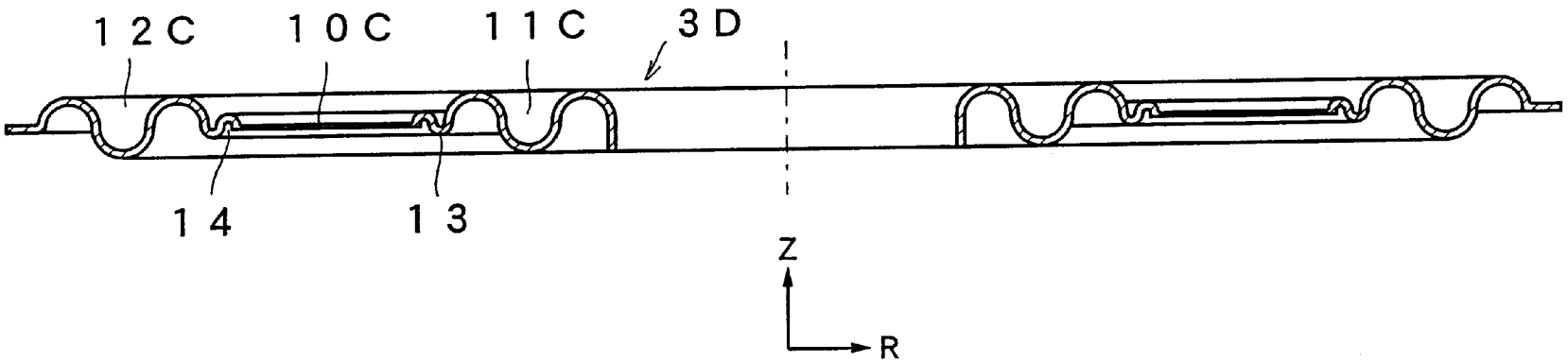
FIG. 16 is a cross-sectional view showing a structure of a loudspeaker damper according to Embodiment 3 of the present invention.

Next, a damper according to Embodiment 3 of the present invention will be described. FIG. 16 is a cross-sectional view showing a structure of damper according to Embodiment 3. The damper 3D includes a flat portion 10C, an inner peripheral waveform portion 11C and an outer peripheral waveform portion 12C. An inner connecting portion 13 is formed at a boundary portion between the flat portion 10C and the inner peripheral waveform portion 11C. An outer connecting portion 14 is formed at a boundary portion between the flat portion 10C and the outer peripheral waveform portion 12C. A reference letter Z shown in FIG. 16 indicates a direction that a voice coil vibrates in a case of using the damper 3D for a loudspeaker. A reference letter R indicates a radial direction of the damper 3D.

The inner connecting portion 13 is configured by an annular waveform having a height (depth) equal to or lower than a groove height (or a groove depth) of a concave or a convex of the inner and outer peripheral waveform portions. The inner connecting portion 13 connects the inner peripheral waveform portion 11C to an inner periphery of the flat portion 10C. The outer connecting portion 14 is configured by an annular waveform having a groove height equal to or lower than an amplitude of a concave or a convex of the inner and outer peripheral waveform portions. The outer connecting portion 14 connects the outer peripheral waveform portion 12C to an outer periphery of the flat portion 10C.

By providing the flat portion 10C as in the above-described embodiments, the damper 3D hardly expands and contracts in the R direction. With respect to the direction Z that the voice coil bobbin 1 vibrates, a desired amplitude can be ensured by providing the inner peripheral waveform portion 11C and the outer peripheral waveform portion 12C. When portions of flat damper with large stress shown in FIG. 3 are made to be easily movable, elastic fatigue of damper material can be reduced. For this reason, limitation of amplitude of vibration at the inner peripheral portion of the damper 3D is relaxed. As a result, the rolling phenomenon hardly occurs and a loudspeaker damper with excellent linearity can be obtained. Such effects are the same as in Embodiment 1.

Further, the flat portion 10C is connected via the inner connecting portion 13 to the inner peripheral waveform portion 11C. The flat portion 10C is also connected via the outer connecting portion 14 to the outer peripheral waveform portion 12C. Accordingly, the inner peripheral waveform portion 11C and the outer peripheral waveform portion 12C are easy to move and a linearity is improved. When a large input is applied and vibration occurs with large amplitude, as compared to the case in which the inner and outer connecting portions are not provided, a stress applied to connecting portions of the flat portion and the waveform portion can be distributed. Consequently, durability of damper is improved, and elastic fatigue of connecting portions and break thereof can be prevented.

Referring to FIG. 16, although the number of convexes and concaves of the inner connecting portion 13 and the outer connecting portion 14 is two, any number of concaves and convexes may be used. If Young's modulus on radial direction of the outer connecting portion and the inner connecting portion are smaller than Young's modulus on radial direction of the outer peripheral waveform portion and the inner peripheral waveform portion, mobility and linearity are even further improved. If viscoelasticities of the outer connecting portion and the inner connecting portion are larger than radial viscoelasticities of the outer peripheral waveform portion and the inner peripheral waveform portion, distortion due to stress can be absorbed by internal loss. At this time, durability of damper is even further improved. Further, linearity, rolling suppressing effect, durability and easiness of manufacturing of damper are improved depending on materials and shapes selected, and a minimum resonance frequency of loudspeaker can be finely adjusted.

(Embodiment 4)

Figure 17:
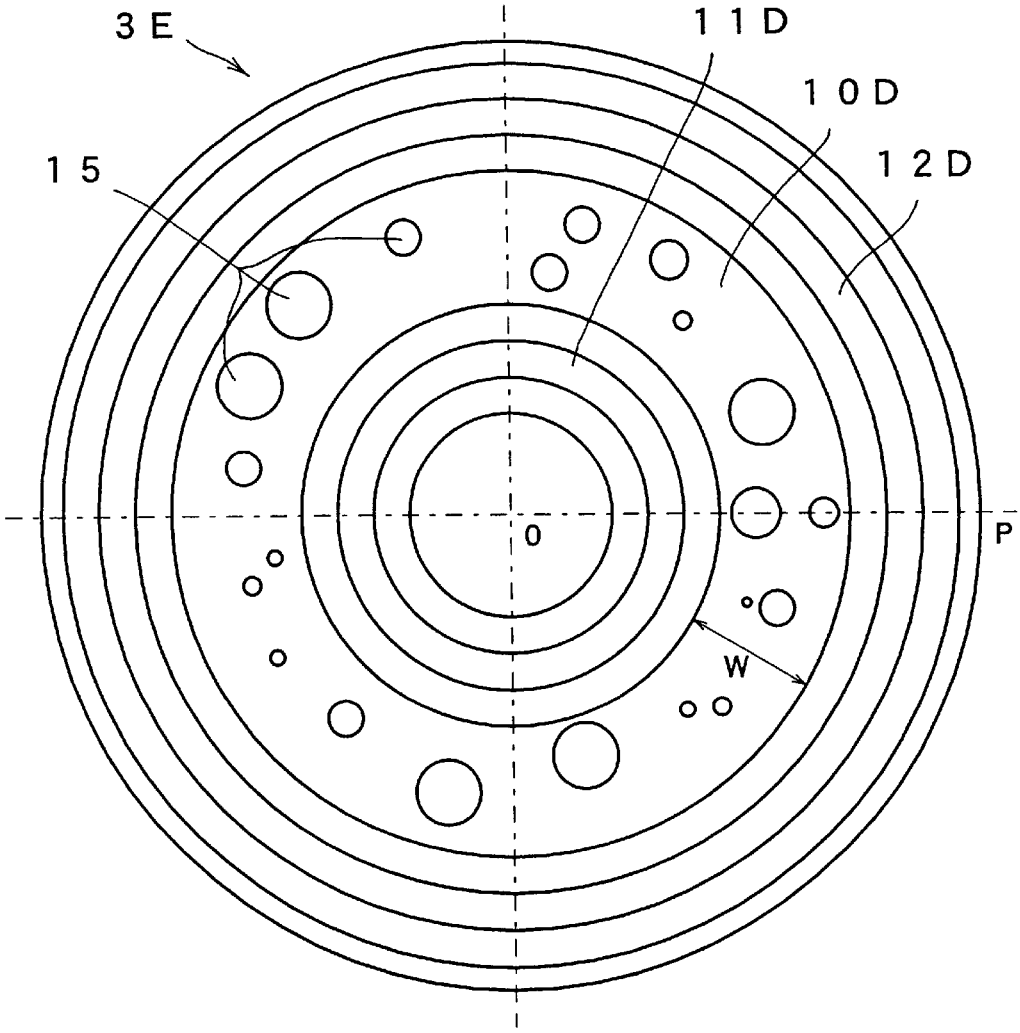
FIG. 17 is a plan view showing a structure of a loudspeaker damper according to Embodiment 4 of the present invention.
Figure 18:
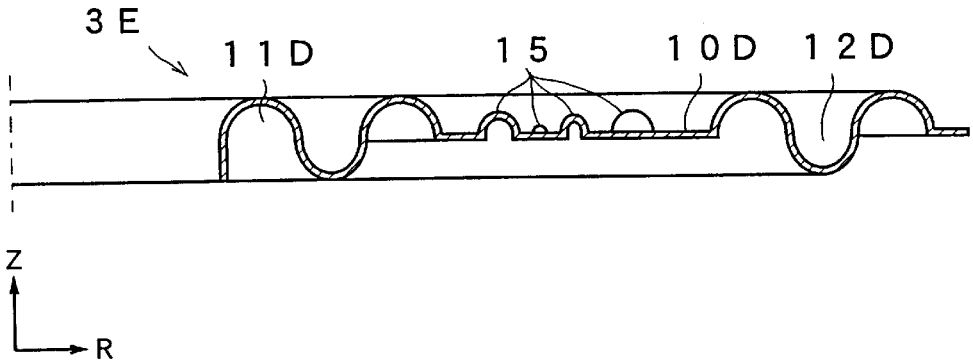
FIG. 18 is a cross-sectional view showing the structure of the loudspeaker damper according to Embodiment 4.

Next, a damper according to Embodiment 4 of the present invention will be described. FIG. 17 is a plan view showing a structure of damper of Embodiment 4. FIG. 18 is a cross-sectional view taken along line O-P shown in FIG. 17. The damper 3E includes a flat portion 10D, an inner peripheral waveform portion 11D and an outer peripheral waveform portion 12D. A large number of protruding portions 15 are provided at the flat portion 10D. In accordance with Embodiment 4, the protruding portions 15 are formed in a hemispherical shape. Diameters of the protruding portions 15 and their positions are random. A reference letter Z shown in FIG. 18 indicates a direction that a voice coil vibrates when the damper 3E is assembled into a loudspeaker. A reference letter R indicates a radial direction of the damper.

Effects of the damper with such structure will be described. By providing the flat portion 10D, the damper 3E hardly expands and contracts in the R direction. With respect to a direction that a voice coil bobbin vibrates, a desired amplitude is ensured by providing the inner peripheral waveform portion 11D and the outer peripheral waveform portion 12D. Further, portions of flat damper with large stress shown in FIG. 3 are made to be easily movable, so that elastic fatigue of damper material can be reduced. Thus, vibration of the damper 3E is not suppressed. Further, the rolling phenomenon hardly occurs and a loudspeaker damper with excellent linearity can be obtained. In this way, the same effects as those of Embodiment 1 can be obtained.

The flat portion 10D easily resonates, because of its cross-sectional shape, at a frequency that a peripheral width W is ½ wavelength. For this reason, a tone quality of loudspeaker may be deteriorated by resonance. A resonance point can be distributed by providing protruding portions shown in FIGS. 17 and 18 at the flat portion 10D. As a result, deterioration of tone quality at a specific resonance frequency can be prevented. Because a strength in the R direction is increased due to the protruding portions, the rolling phenomenon can be suppressed. Referring to FIGS. 17 and 18, the protruding portions 15 are provided so as to protrude upward. Nevertheless, the same effect can be obtained if the protruding portions are provided so as to protrude downward.

Figure 19:
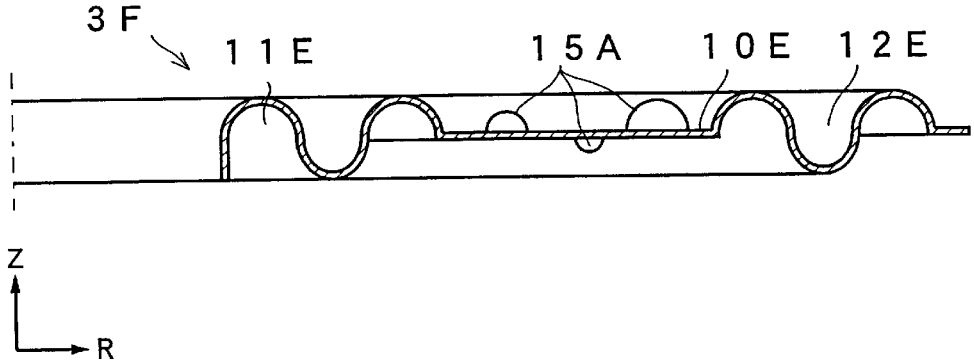
FIG. 19 is a cross-sectional view showing a structure of a loudspeaker damper with another shape (1) according to Embodiment 4.

FIGS. 19 through 23 are views showing another structural examples of the damper of Embodiment 4. FIG. 19 is a cross-sectional view showing a structure of damper 3F having hollow protruding portions. The damper 3F shown in FIG. 19 includes a flat portion 10E, an inner peripheral waveform portion 11E and an outer peripheral waveform portion 12E. A plurality of hemispherical shell protruding portions 15A may be provided at one surface of the flat portion 10E or may be provided at opposite surfaces thereof.

Figure 20:
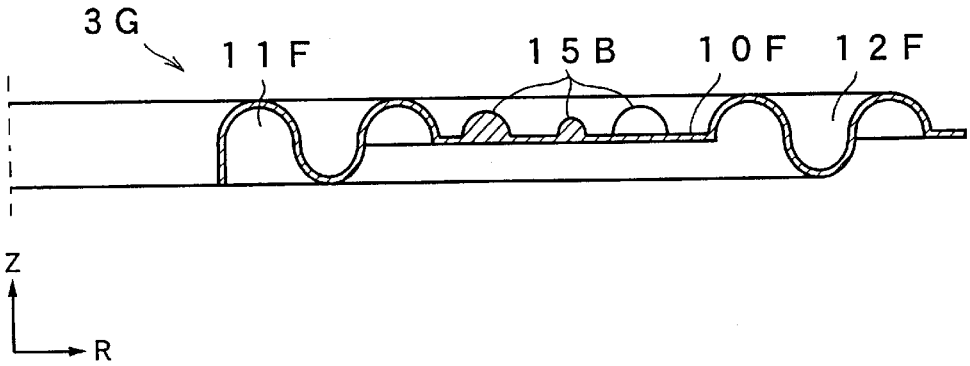
FIG. 20 is a cross-sectional view showing a structure of a loudspeaker damper with still another shape (2) according to Embodiment 4.

FIG. 20 is a cross-sectional view showing a structure of damper 3G having a plurality of filled protruding portions (which hereinafter refers to as solid protruding portions). The damper 3G shown in FIG. 20 includes a flat portion 10F, an inner peripheral waveform portion 11F and an outer peripheral waveform portion 12F. A plurality of hemispherical filled protruding portions 15B are provided at the flat portion 10F. When a damper is formed by pressing a sheet material with uniform thickness into a die, an interior of each of protruding portions is a cavity as shown in FIG. 19. When a damper is die-formed by injecting a resin, an interior of each of the protruding portions is filled with resin as shown in FIG. 20. A designer can freely select materials by taking weight of damper, resonance suppressing effect, rolling suppressing effect and formability into consideration.

Figure 21:
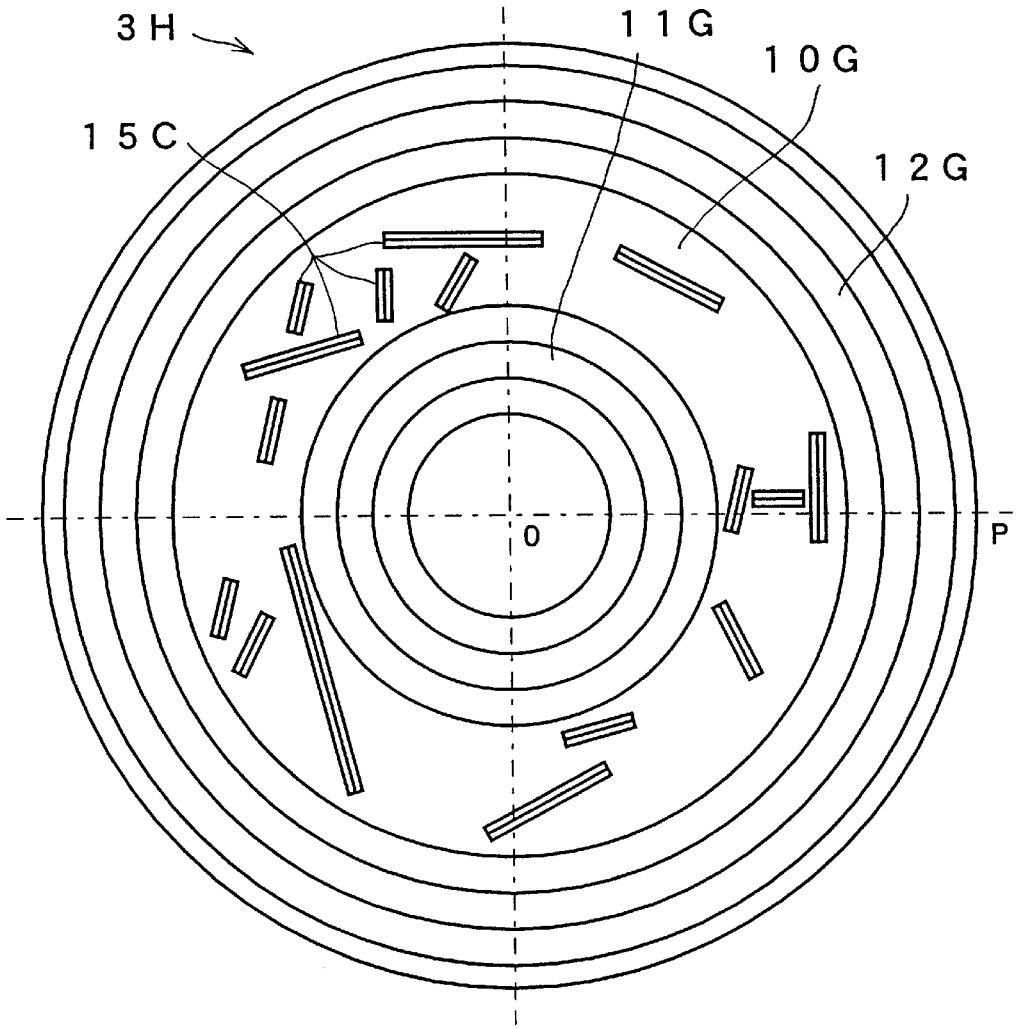
FIG. 21 is a plan view showing a structure of a loudspeaker damper with yet another shape (3) according to Embodiment 4.
Figure 22:
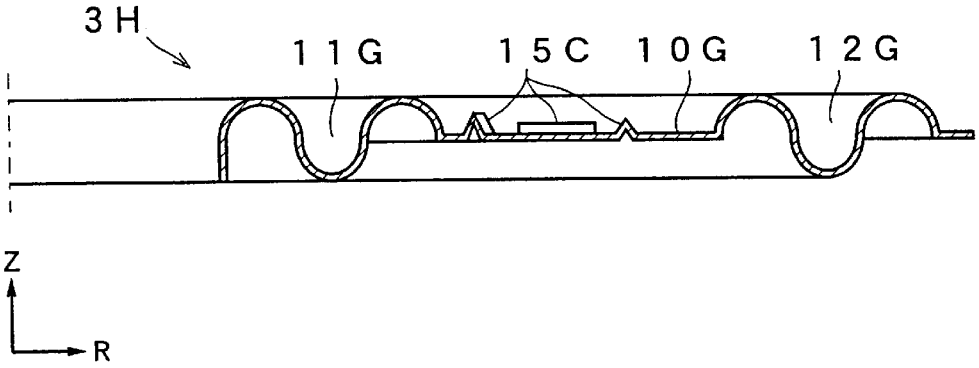
FIG. 22 is a cross-sectional view taken along line O-P, showing the structure of the loudspeaker damper with yet another shape (3) according to Embodiment 4.

FIG. 21 is a plan view showing a structure of damper 3H having a plurality of stripe-shaped protruding portions with triangular cross-sectional shape. FIG. 22 is a cross-sectional view taken along line O-P shown in FIG. 21. The damper 3H shown in FIGS. 21 and 22 includes a flat portion 10G, an inner peripheral waveform portion 11G and an outer peripheral waveform portion 12G. A plurality of stripe-shaped protruding portions 15C with triangular cross-sectional shape are provided at the flat portion 10G. A length, a direction and a position of each of the protruding portions 15C are at random as shown in FIG. 21.

Figure 23:
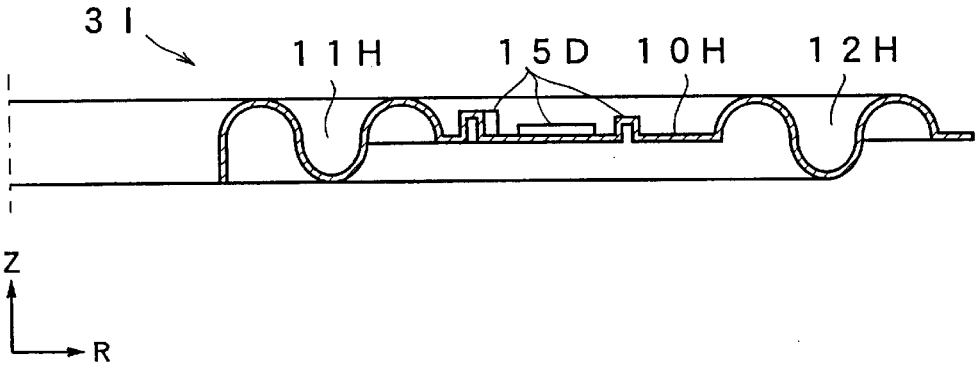
FIG. 23 is a cross-sectional view showing a structure of a loudspeaker damper with yet another shape (4) according to Embodiment 4.

FIG. 23 is a cross-sectional view showing a structure of damper 3I having a plurality of stripe-shaped protruding portions with rectangular cross-sectional shape. The damper 3I shown in FIG. 23 includes a flat portion 10H, an inner peripheral waveform portion 11H and an outer peripheral waveform portion 12H. A plurality of stripe-shaped protruding portions with rectangular cross-sectional shape are provided at the flat portion 10H. The stripe-shaped protruding portions 15 are placed at random. These stripe-shaped protruding portions may be made of materials different from the damper 3H or 3I and may be affixed to the annular flat surface. For example, portions other than the stripe-shaped protruding portions are integrally formed of fabrics and the stripe-shaped protruding portions are formed of plastic or aluminum. Then, the stripe-shaped protruding portions may be affixed to the flat portion 10H. If the stripe-shaped protruding portion is made of materials with high Young's modulus, an effect of reinforcing the flat portion is enhanced. Further, effects of suppressing the rolling phenomenon and resonance can be obtained. Alternatively, if the stripe-shaped protruding portion is made of material with high viscoelasticity, e.g., a rubber, the Q factor of resonance of the flat portion can be reduced and an effect of suppressing resonance can be obtained. The stripe-shaped protruding portions may have hemispherical cross-sectional shape or any polygonal cross-sectional shape.

(Embodiment 5)

Figure 24:
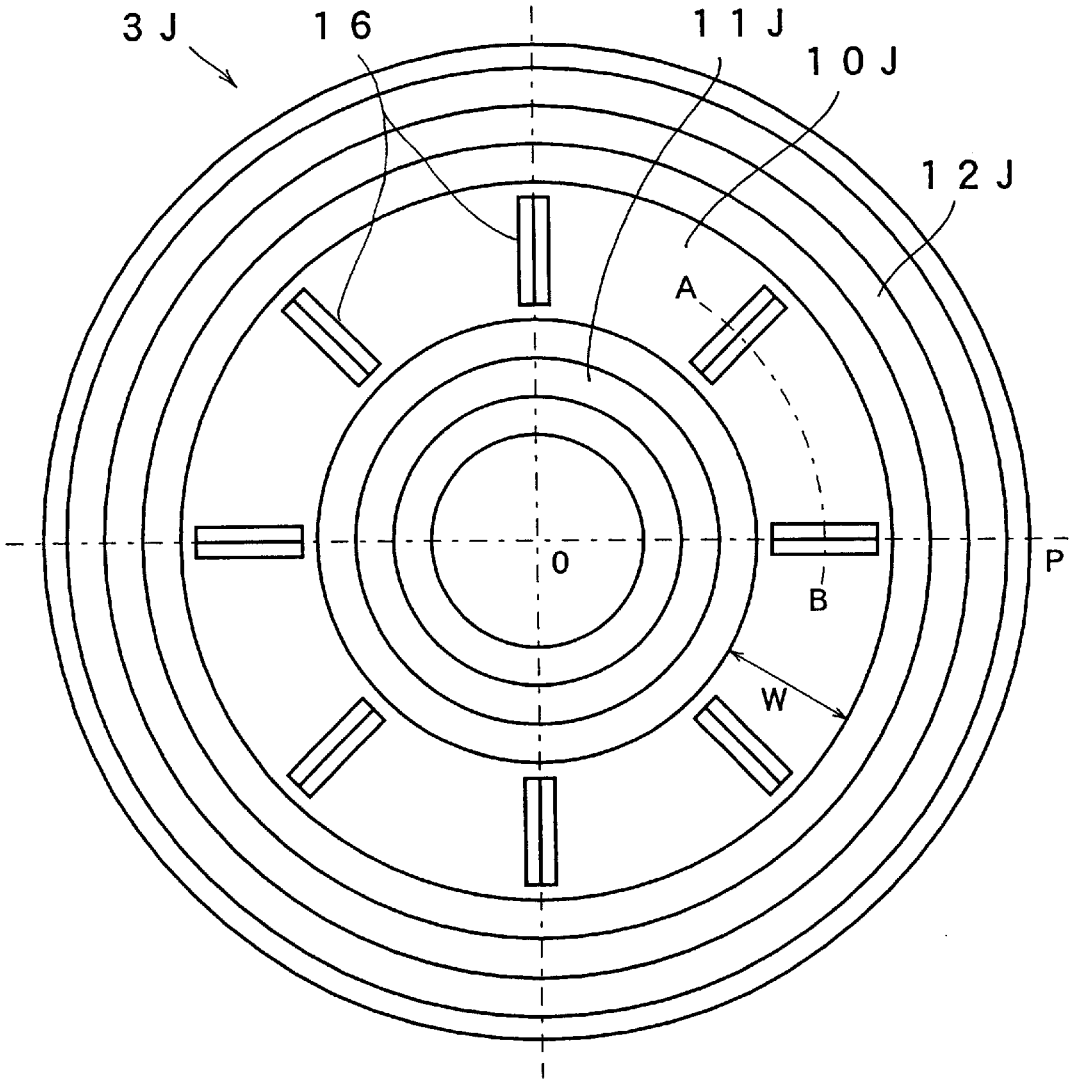
FIG. 24 is a plan view showing a structure of a loudspeaker damper according to Embodiment 5 of the present invention.
Figure 25:
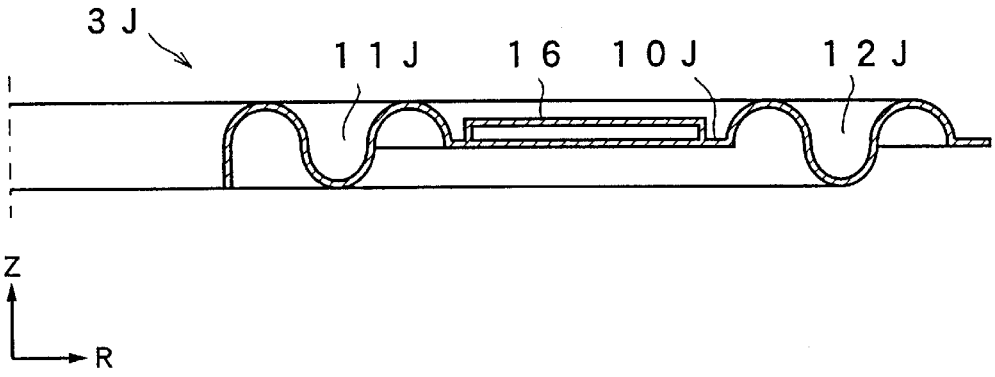
FIG. 25 is a cross-sectional view taken along line O-P, showing the structure of the loudspeaker damper according to Embodiment 5.
Figure 26:
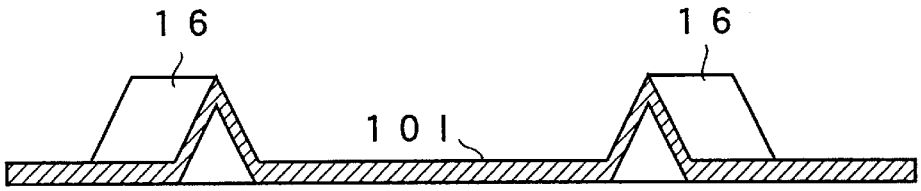
FIG. 26 is a cross-sectional view taken along line A-B, showing the structure of the loudspeaker damper according to Embodiment 5.

A damper of Embodiment 5 of the present invention will be described. FIG. 24 is a plan view showing a structure of damper of Embodiment 5. FIG. 25 is a cross-sectional view taken along line O-P shown in FIG. 24. FIG. 26 is a cross-sectional view taken along line A-B shown in FIG. 24. The damper 3J includes a flat portion 10J, an inner peripheral waveform portion 11J and an outer peripheral waveform portion 12J. A plurality of radial protruding portions 16 are provided at the flat portion 10J. Each of the radial protruding portions 16 has, as shown in FIG. 26, a triangular cross-sectional shape and is formed in a hollow stripe shape. As shown in FIG. 24, the radial protruding portions 16 are radially disposed along a radial direction of the damper 3J. A reference letter Z shown in FIG. 25 indicates a direction that a voice coil vibrates when the damper 3J is assembled into a loudspeaker. A reference letter R indicates a radial direction of the damper 3J.

Effects of the damper with above-described structure will be described. Because the flat portion 10J is provided, the damper 3J hardly expands or contracts in the R direction. With respect to the direction Z that a voice coil bobbin vibrates, because of the inner peripheral waveform portion 11J and the outer peripheral waveform portion 12J, portions of flat damper that receive a large stress easily move. For this reason, an amplitude of the damper 3J at a time of its vibration is ensured. The rolling phenomenon hardly occurs and a loudspeaker damper with excellent linearity can be obtained. In this way, the same effects as in Embodiment 1 can be obtained.

The flat portion easily resonates, due to its cross-sectional shape, at a frequency that a peripheral width W serves as ½ wavelength. A tone quality of loudspeaker may be deteriorated by such resonance. As the flat portion 10J of Embodiment 5 is provided with the radial protruding portions 16, the flat portion 10J is reinforced and thus resonance can be suppressed. A strength in the R direction is increased because of the radial protruding portions 16, an effect of suppressing the rolling phenomenon is enhanced. This effect is the same as that of Embodiment 3.

Figure 27:
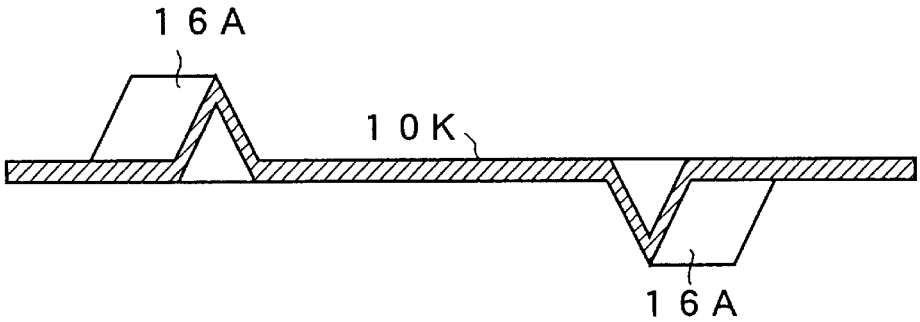
FIG. 27 is a cross-sectional view taken along line A-B, showing a structure of a loudspeaker damper with another shape (1) according to Embodiment 5.
Figure 28:
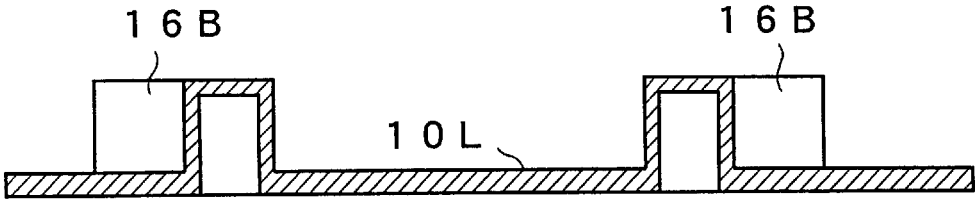
FIG. 28 is a cross-sectional view taken along line A-B showing a structure of a loudspeaker damper with still another shape (2) according to Embodiment 5.
Figure 29:
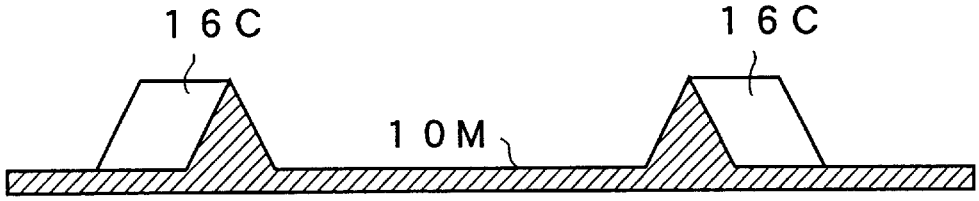
FIG. 29 is a cross-sectional view taken along line A-B showing a structure of a loudspeaker damper with yet another shape (3) according to Embodiment 5.

FIGS. 27 through 29 show another structural examples of the radial protruding portion. Referring to FIG. 26, the hollow radial protruding portions 16 are provided so as to protrude upward from the flat portion 10J. Nevertheless, as in a flat portion 10K shown in FIG. 27, the same effect can be obtained when radial protruding portions 16A are protruded upward and downward. Alternatively, the radial protruding portions may be protruded upward and downward and alternately disposed along a circumferential direction.

As shown by a flat portion 10L of FIG. 28, each of radial protruding portions 16B may have a hollow rectangular cross-sectional shape. Further, as shown by a flat portion 10M of FIG. 29, each of radial protruding portions 16C may have a solid triangular cross-sectional shape. A designer can freely select these shapes by taking easiness of forming, effect of suppressing resonance of flat portion, effect of suppressing the rolling phenomenon and weight of damper into consideration.

The radial protruding portions of Embodiment 5 may be formed of other materials and affixed to the flat portion. For example, portions other than the radial protruding portions are integrally formed of fabrics and the radial protruding portions are formed of plastic or aluminum. Then, the radial protruding portions may be applied to the flat portion. If the radial protruding portion is made of materials with high Young's modulus as described above, the effect of reinforcing the flat portion is enhanced and effects of suppressing the rolling phenomenon and resonance can be obtained. If the radial protruding portion is made of material with high viscoelasticity, e.g., a rubber, sharpness of resonance of the flat portion can be reduced and the effect of suppressing the resonance is enhanced.

Figure 30:
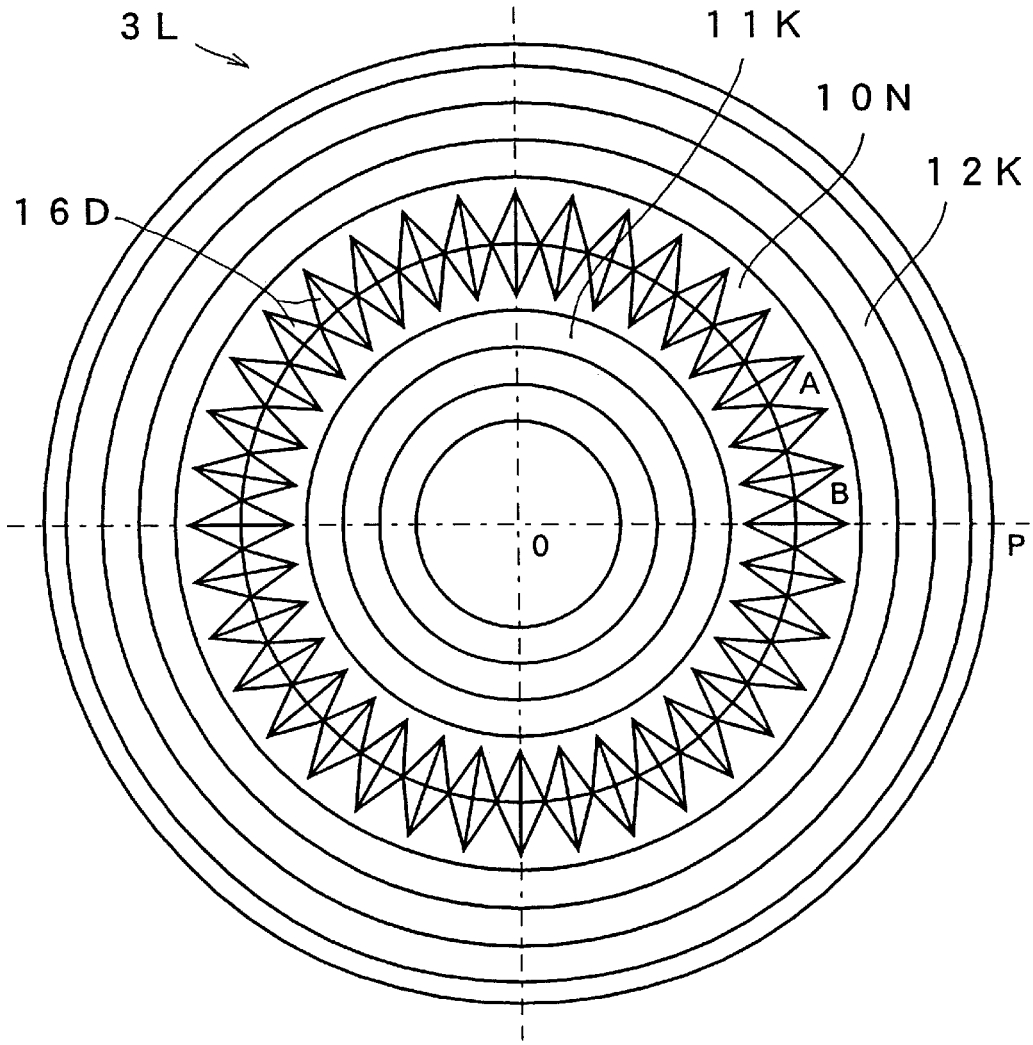
FIG. 30 is a plan view showing a structure of a loudspeaker damper with yet another shape (4) according to Embodiment 5.
Figure 31:
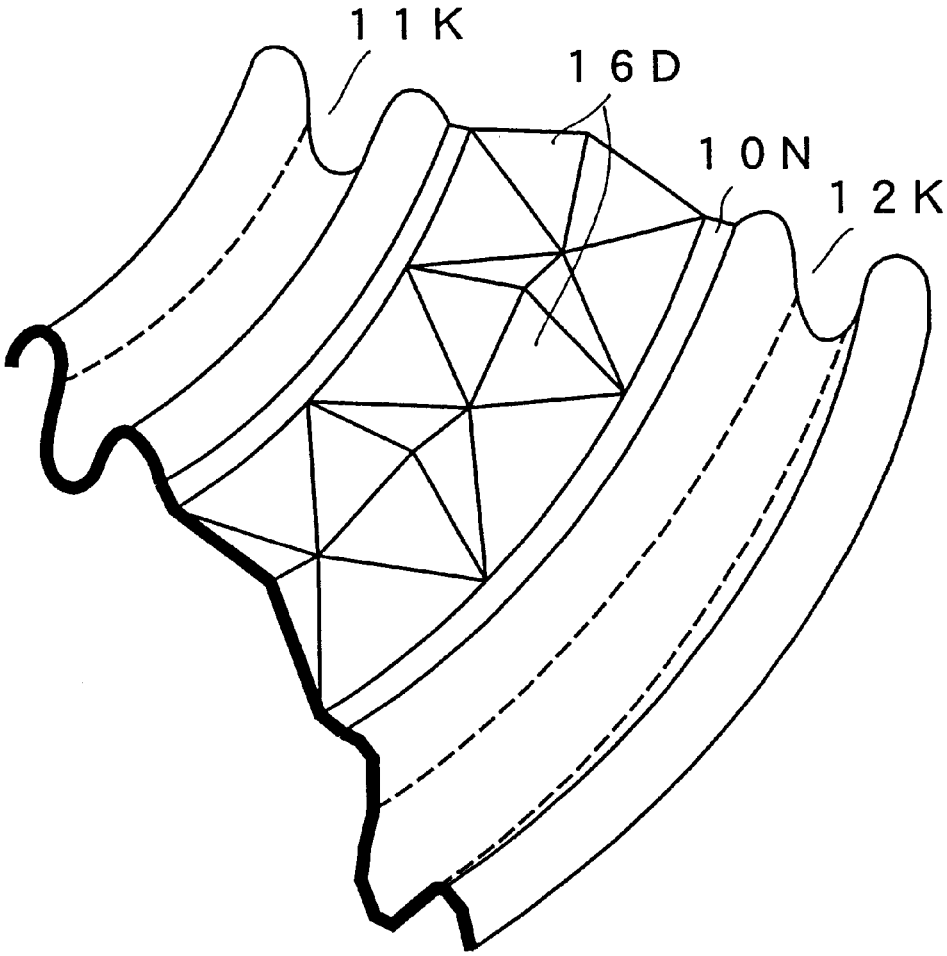
FIG. 31 is a perspective view showing a protruding portion of the loudspeaker damper with yet another shape (4) according to Embodiment 5.
Figure 32:
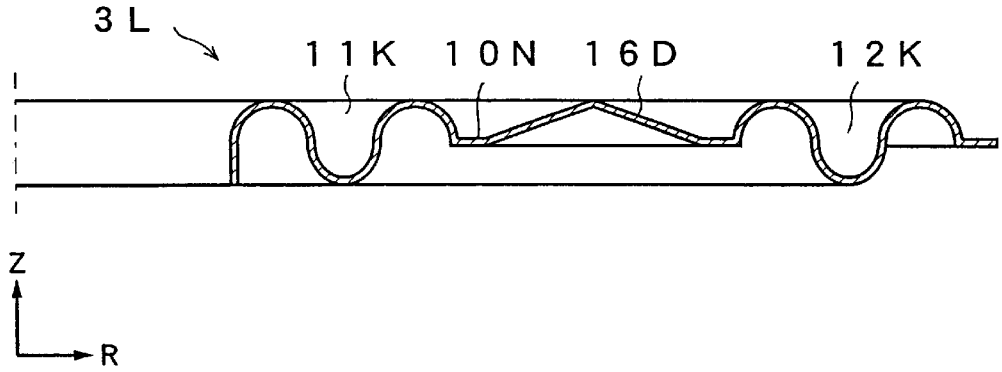
FIG. 32 is a cross-sectional view taken along line O-P, showing the structure of the loudspeaker damper with yet another shape (4) according to Embodiment 5.
Figure 33:
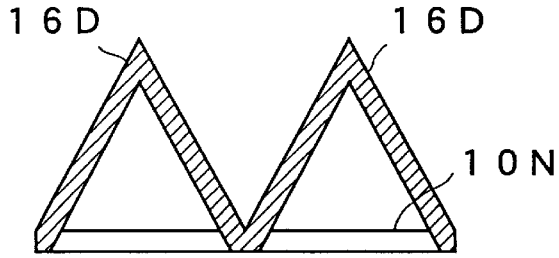
FIG. 33 is a cross-sectional view taken along line A-B, showing the structure of the loudspeaker damper with yet another shape (4) according to Embodiment 5.

FIGS. 30 through 33 show another structural examples of the damper of Embodiment 5. FIG. 30 is a plan view showing a structure of damper 3L. FIG. 31 is a perspective view of protruding portion. FIG. 32 is a cross-sectional view taken along line O-P shown in FIG. 30. FIG. 33 is a cross-sectional view taken along line A-B, i.e., a cross-sectional view showing a center of protruding portion along a circumferential direction. The damper 3L includes a flat portion 10N, an inner peripheral waveform portion 11K and an outer peripheral waveform portion 12K. A plurality of quadrangular pyramid shaped protruding portions 16D are provided at the flat portion 10N.

As shown in FIGS. 30 and 31, each of the protruding portions 16D has a rhombic bottom surface and a hollow quadrangular pyramid shape. Because the protruding portions 16D with such shape even further reinforce the flat portion, effects of suppressing the resonance of the flat portion 10N and the rolling phenomenon can be obtained. Although the protruding portions 16D are provided so as to protrude upward in FIG. 33, the protruding portions 16D may be provided so as to protrude downward.

Figure 34:
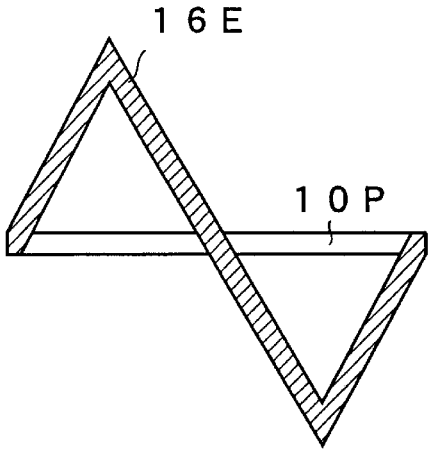
FIG. 34 is a partial cross-sectional view of radial protruding portions showing a structure of a loudspeaker damper with yet another shape (5) according to Embodiment 5.

FIG. 34 shows a cross-sectional view of the same portion showing another structural example of the protruding portion. The protruding portions 16E are formed so as to alternately protrude upward and downward from the flat portion 10P. In this case, the same effect can be obtained.

(Embodiment 6)

Figure 35:
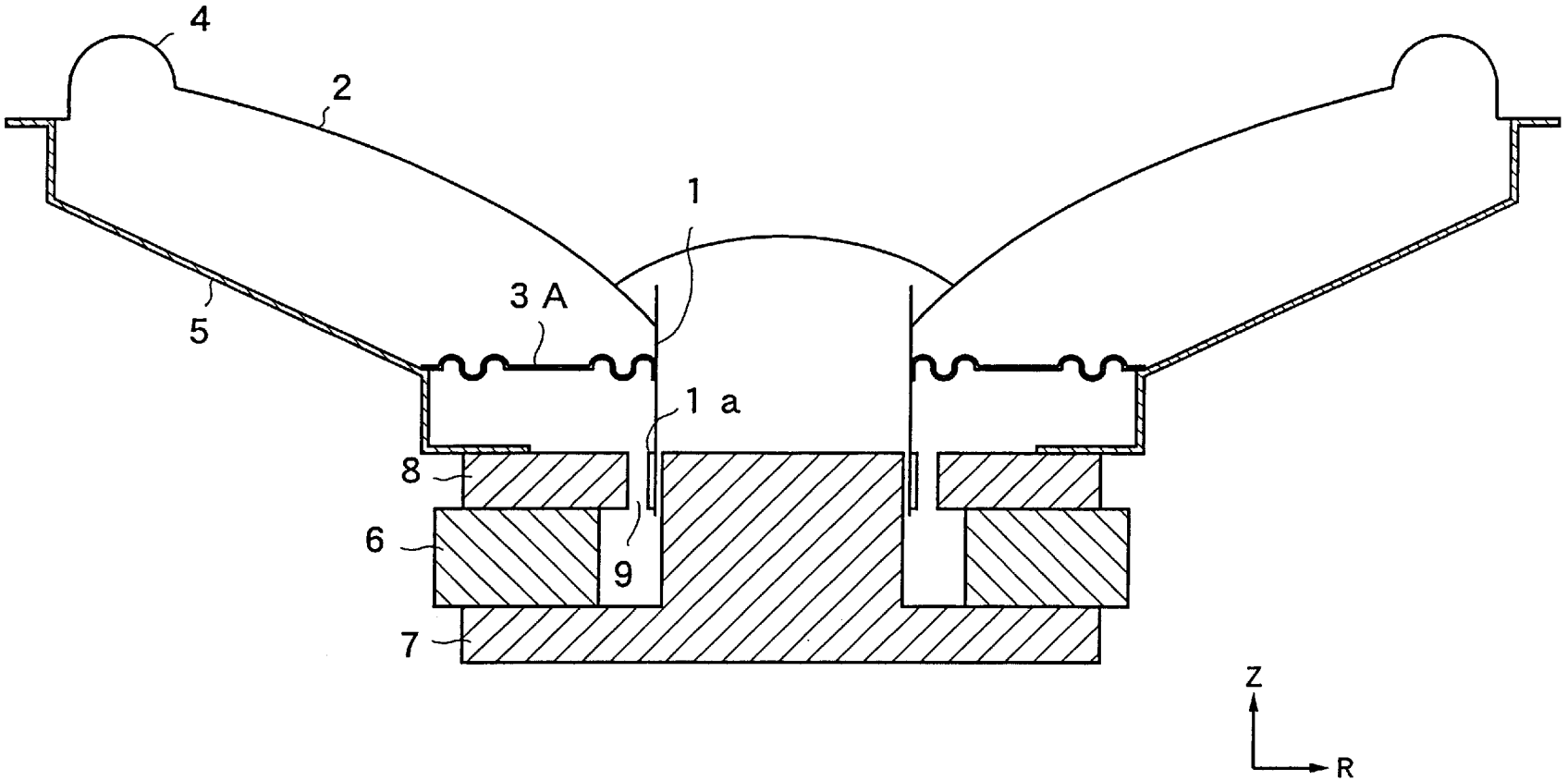
FIG. 35 is a cross-sectional view showing a structure of a loudspeaker according to Embodiment 6-1 of the present invention.

Next, a loudspeaker to which the damper of the above-described embodiments is mounted will be described as Embodiment 6 of the present invention. FIG. 35 is a cross-sectional view showing a structure of loudspeaker of Embodiment 6-1. The same portions as those of loudspeaker shown in FIG. 1 are indicated by the same reference numerals. The loudspeaker is configured so as to include a voice coil bobbin 1, a diaphragm 2, a damper 3A, an edge 4 and a frame 5.

The voice coil bobbin 1 is held by a coaxial damper 3A of Embodiment 1. The voice coil bobbin 1 is supported, together with the diaphragm 2, by the frame 5 so as to freely vibrate. An outer peripheral portion of the diaphragm 2 is supported to the frame 5 by the roll-shaped edge 4.

A magnetic circuit is formed by a magnet 6, a yoke 7 and a plate 8. A desired magnetic flux density is ensured at a magnetic gap 9 of the magnetic circuit. The voice coil 1*a* is held within the magnetic gap 9. A reference letter Z shown in FIG. 35 indicates a direction that the voice coil bobbin vibrates and a reference letter R indicates a radial direction of the damper, which is perpendicular to the vibrating direction.

An operation of the loudspeaker with such structure will be described. When a signal current is applied to the voice coil 1*a*, the voice coil bobbin 1 vibrates, due to a magnetic flux of the magnetic gap 9, at a driving force which is in proportion to the signal current. This vibration is transmitted to the diaphragm 2, so that sound is radiated.

As shown in FIG. 35, when the damper of Embodiment 1 is used, the rolling phenomenon of loudspeaker can be effectively suppressed. The same effects can be obtained when dampers of Embodiments 2 through 5 are used.

Figure 36:
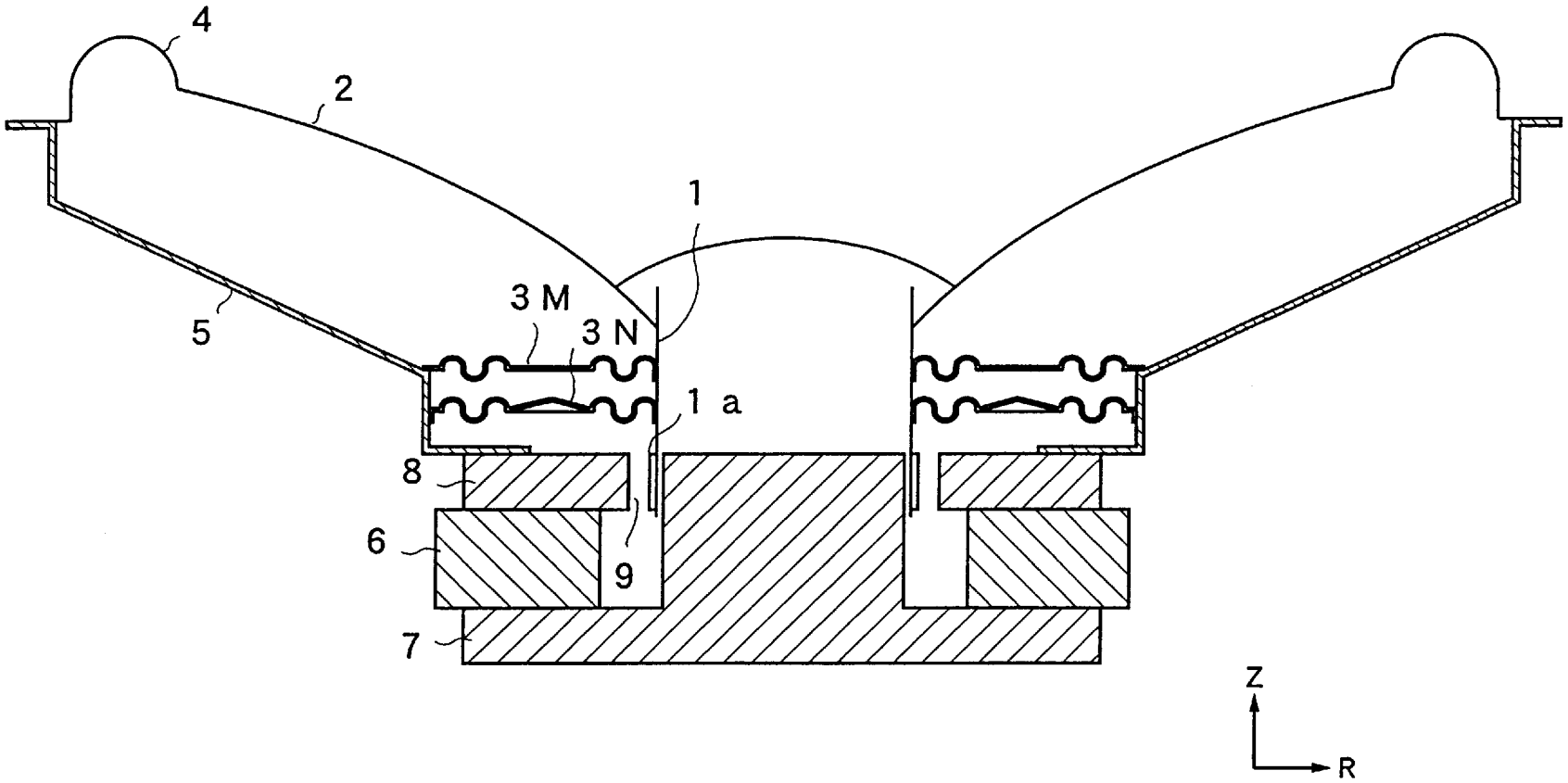
FIG. 36 is a cross-sectional view showing a structure of a loudspeaker according to Embodiment 6-2 of the present invention.

FIG. 36 is a cross-sectional view of loudspeaker of Embodiment 6-2, and the same portions as in FIG. 35 are indicated by the same reference numerals. As shown in FIG. 36, a first damper 3M and a second damper 3N may be used instead of one damper. In accordance with a loudspeaker shown in FIG. 36, since the voice coil bobbin 1 is supported by the first damper 3M and the second damper 3N, an effect of suppressing the rolling phenomenon is significantly enhanced. When an upper limit value of elastic deformation of one damper is limited to a predetermined value, over amplitude of the diaphragm at an over input can be suppressed and deterioration of performance of loudspeaker can be prevented.

Two dampers may be provided by combining the same damper shown in one of Embodiments 1 through 5 or any of two dampers of Embodiments 1 through 5. A designer can freely select dampers by taking the effect of suppressing the rolling phenomenon and linearity in the vibrating direction into consideration.

As described above, in accordance with a loudspeaker damper, a flat portion is provided between an outer peripheral waveform portion and an inner peripheral waveform portion. Thus, the rolling phenomenon of diaphragm and voice coil bobbin can be suppressed. Further, linearity of vibration of diaphragm from a small amplitude to a large amplitude can be realized.

Since protruding portions are provided at a flat portion of damper, a stiffness of the flat portion is improved and resonance of the flat portion can be suppressed. At this time, deterioration of tone quality caused by resonance of the flat portion can be prevented.

In accordance with a loudspeaker of the present invention, the rolling phenomenon can be suppressed even if a diaphragm vibrates at a large amplitude. Accordingly, contact of voice coil when driven at large electric power is eliminated. Further, a positional precision at a time of mounting a voice coil bobbin and a damper to a magnetic circuit is relaxed, and a manufacturing yield of loudspeaker is improved.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The text of Japanese priority application No. 2001-317960 filed on Oct. 16, 2001 is hereby incorporated by reference.

What is claimed is:

1. A loudspeaker damper for use in a loudspeaker having a diaphragm and a voice coil bobbin, said damper including:

an annular member so as to have a central opening portion for connecting to the voice coil bobbin, said annular member comprising:

an outer peripheral waveform portion which has at least one concave or convex annular waveform at an outer peripheral portion;

an inner peripheral waveform portion which has at least one concave or convex annular waveform at an inner peripheral portion around said central opening portion; and a flat portion which is provided between said outer peripheral waveform portion and said inner peripheral waveform portion and has an annular flat surface.

2. A loudspeaker damper according to claim 1, wherein an annular width of said flat portion is equal to or more than a groove width of the annular waveform of said outer peripheral waveform portion or said inner peripheral waveform portion.

3. A loudspeaker damper according to claim 1, wherein inner and outer peripheral profiles of said outer peripheral waveform portion are formed in an elliptic shape and at least an outer peripheral profile of said flat portion is formed in an elliptic shape.

4. A loudspeaker damper according to claim 1, wherein a Young's modulus in a radial direction of said flat portion is larger than at least one of Young's modulus in a radial direction of said outer peripheral waveform portion and a Young's modulus in a radial direction of said inner peripheral waveform portion.

5. A loudspeaker damper according to claim 1, wherein an outer connecting portion with at least one concave or convex annular waveform is provided at an annular boundary between said flat portion and said outer peripheral waveform portion, and an inner connecting portion with at least one concave or convex annular waveform is provided at an annular boundary between said flat portion and said inner peripheral waveform portion.

6. A loudspeaker damper according to claim 5, wherein a groove height of said concave or convex annular waveform of said outer connecting portion is lower than a groove height of the annular waveform of said outer peripheral waveform portion, and a groove height of the annular waveform of said inner connecting portion is smaller than a groove height of the annular waveform of said inner peripheral waveform portion.

7. A loudspeaker damper according to claim 5, wherein a Young's modulus in a radial direction of said outer connecting portion and said inner connecting portion are smaller than a Young's modulus in a radial direction of said outer peripheral waveform portion and said inner peripheral waveform portion.

8. A loudspeaker damper according to claim 5, wherein viscoelasticities of said outer connecting portion and said inner connecting portion are larger than radial viscoelasticities of said outer peripheral waveform portion and said inner peripheral waveform portion.

9. A loudspeaker damper according to claim 1, wherein a plurality of protruding portions are provided on at least one of upper surface and lower surface of said flat portion for suppressing resonance of said flat portion.

10. A loudspeaker damper according to claim 9, wherein said protruding portions are radially disposed along an annular flat surface of said flat portion.

11. A loudspeaker damper according to claim 9, wherein said protruding portions are stripe-shaped protruding portions and have a polygonal cross-sectional shape.

12. A loudspeaker damper according to claim 9, wherein said protruding portions are stripe-shaped protruding portions radially formed on said annular flat surface of said flat portion and have a polygonal cross-sectional shape.

13. A loudspeaker damper according to claim 12, wherein said protruding portions are alternately disposed at the upper and lower surfaces of said flat portion so as to be adjacent to each other along a circumferential direction.

14. A loudspeaker damper according to claim 9, wherein said protruding portions are stripe-shaped protruding portions with random direction and length which are formed on said annular flat surface of said flat portion, and have a polygonal cross-sectional shape.

15. A loudspeaker damper according to claim 9, wherein said protruding portions are quadrangular pyramids having rhombic bottom surfaces disposed on the annular flat surface of said flat portion, and said quadrangular pyramids are radially disposed along said annular flat surface.

16. A loudspeaker damper according to claim 9, wherein said protruding portions are made of any of materials including a metal, a polymer resin and an viscoelastic body.

17. A loudspeaker comprising:

a loudspeaker frame;

a diaphragm which has an outer peripheral portion held by said loudspeaker frame with an edge so as to vibrate and applies aerial vibration;

a cylindrical voice coil bobbin which is coupled to an inner peripheral portion of said diaphragm;

a voice coil which is wound around said voice coil bobbin;

a magnetic circuit which applies an electromagnetic force to said voice coil; and a damper which has an outer peripheral portion held by said loudspeaker frame so as to vibrate and which has a central opening portion to hold said voice coil bobbin in the central opening so as to axially vibrate, wherein said damper includes:

an outer peripheral waveform portion which has at least one concave or convex annular waveform at an outer peripheral portion;

an inner peripheral waveform portion which has at least one concave or convex annular waveform at an inner peripheral portion around the central opening portion; and a flat portion which is provided between said outer peripheral waveform portion and said inner peripheral waveform portion and has an annular flat surface.

18. A loudspeaker comprising:

a loudspeaker frame;

a diaphragm which has an outer peripheral portion is held by said loudspeaker frame with an edge so as to vibrate and applies aerial vibration;

a cylindrical voice coil bobbin which is coupled to an inner peripheral portion of said diaphragm;

a voice coil which is wound around said voice coil bobbin;

a magnetic circuit which applies an electromagnetic force to said voice coil; and first and second dampers which have outer peripheral portions held by said loudspeaker frame so as to freely vibrate, have inner peripheral portions fixed to two different axial positions of said voice coil bobbin, and have a central opening portion, respectively to hold said voice coil bobbin in the central opening so as to axially vibrate, wherein said first and second dampers include:

an outer peripheral waveform portion which has at least one concave or concave annular waveform at an outer peripheral portion;

an inner peripheral waveform portion which has at least one concave or convex annular waveform at an inner peripheral portion around the central opening portion; and a flat portion which is provided between said outer peripheral waveform portion and said inner peripheral waveform portion and has an annular flat surface.

* * * * *